US006321583B1

(12) United States Patent
Ikezaki et al.

(10) Patent No.: US 6,321,583 B1
(45) Date of Patent: Nov. 27, 2001

(54) MULTIFUNCTION ROLLING MILL FOR H-BEAM AND ROLLING METHOD OF ROLLING H-BEAM WITH MULTIFUNCTION ROLLING MILL

(75) Inventors: Toru Ikezaki, Kitakyushu; Takashi Suzuki, Fujieda; Takashi Haji; Hideo Mizutani, both of Kitakyushu, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/445,846

(22) PCT Filed: Apr. 15, 1999

(86) PCT No.: PCT/JP99/02021

§ 371 Date: Dec. 14, 1999

§ 102(e) Date: Dec. 14, 1999

(87) PCT Pub. No.: WO99/54064

PCT Pub. Date: Oct. 28, 1999

(30) Foreign Application Priority Data

| | | |
|---|---|---|
| Apr. 15, 1998 | (JP) | 10-123005 |
| Aug. 27, 1998 | (JP) | 10-259359 |
| Oct. 7, 1998 | (JP) | 10-285701 |
| Oct. 20, 1998 | (JP) | 10-298846 |
| Oct. 21, 1998 | (JP) | 10-300008 |
| Oct. 21, 1998 | (JP) | 10-300161 |
| Feb. 2, 1999 | (JP) | 11-025281 |

(51) Int. Cl.[7] ..... B21B 13/10

(52) U.S. Cl. ..... 72/225; 72/226

(58) Field of Search ..... 72/226, 225, 224, 72/240, 229

(56) References Cited

U.S. PATENT DOCUMENTS

| | | | | |
|---|---|---|---|---|
| 4,702,099 | * | 10/1987 | Sturm | 72/225 |
| 4,918,964 | * | 4/1990 | Engel et al. | 72/225 |
| 4,958,509 | * | 9/1990 | Kubasa et al. | 72/225 |
| 5,000,020 | * | 3/1991 | Rohde et al. | 72/225 |
| 5,052,206 | * | 10/1991 | Reismann et al. | 72/225 |
| 5,085,065 | * | 2/1992 | Onderka et al. | 72/225 |

FOREIGN PATENT DOCUMENTS

| | | | |
|---|---|---|---|
| 3-189001 A | * | 8/1991 | (JP) . |
| 4-251603 A | * | 9/1992 | (JP) . |
| 9-1203 | | 1/1997 | (JP) . |

* cited by examiner

*Primary Examiner*—Lowell A. Larson
(74) *Attorney, Agent, or Firm*—Kenyon & Kenyon

(57) ABSTRACT

There is provided a multifunction rolling mill for rolling an H-beam including: a pair of right and left vertical rollers composed of flange thickness reduction rollers; web thickness reduction horizontal rollers; and a pair of upper and lower horizontal rollers arranged on both sides of the web thickness reduction rollers, having flange width reduction rollers freely moved in the vertical direction by retracting mechanisms. In the case of reduction of flange thickness and web thickness rolling, the flange width reduction rollers of the above horizontal rollers are moved upward and downward so that the flange width reduction rollers of the horizontal rollers do not interfere with the vertical rollers.

4 Claims, 24 Drawing Sheets

MULTIFUNCTION ROLLING MILL FOR H-BEAM AND ROLLING METHOD OF ROLLING H-BEAM WITH MULTIFUNCTION ROLLING MILL

FIELD OF THE INVENTION

The present invention relates to a multifunction rolling mill for rolling an H-beam capable of conducting both edging-rolling and universal-rolling with a single rolling mill. Also, the present invention relates to a rolling method of rolling an H-beam with the multifunction rolling mill.

DESCRIPTION OF THE PRIOR ART

Concerning an apparatus for rolling an H-beam, for example, rolling apparatus B for rolling an H-beam is disclosed in Japanese Unexamined Patent Publication No. 56-109101. The arrangement of the rolling apparatus disclosed in the above patent publication is briefly shown in FIGS. 19 and 20. As shown in the drawings, rolling apparatus B for rolling an H-beam includes a breakdown rolling mill 70, a universal rough rolling mill 71, an edger rolling mill 72 and a universal finish rolling mill 73 which are arranged in series.

According to the rolling method of rolling an H-beam with the above rolling apparatus B, rolling is conducted as follows. First, a piece of work to be rolled 87 such as a slab or a beam blank is roughly rolled into a predetermined configuration with the breakdown rolling mill 70 as shown in FIGS. 19 and 20. After that, intermediate rolling is conducted by a plurality of passes with the universal rough rolling mill 71 and the edger rolling mill 72. Then, the piece of work to be finally rolled is rolled into an H-beam 86, which is a final product, with the universal finish rolling mill 73. Specifically, the rolling method is described as follows. As shown in FIG. 20, the piece of work 87 to be rolled is roughly rolled with the breakdown rollers 74, 75 of the breakdown rolling mill 70. Then, the web and flange of the H-beam are rolled with the horizontal rollers 76, 77 and the vertical rollers 78, 79 of the universal rough rolling mill 71. Then, reduction is given to both edge portions of the flange of the H-beam by the edger rollers 80, 81, so that the flange width can determined. In the universal finish rolling mill 73, the web and flange are rolled with the horizontal rollers 82, 93 and the vertical rollers 84, 85, whereby the flange is formed so that the flange angle can be kept at 90° with respect to the web.

However, the following problems to be solved may be encountered in the above rolling apparatus B for rolling the H-beam.

As shown in FIG. 19, it is necessary to provide the universal rough rolling mill 71 and the universal finish rolling mill 73 for rolling the web and flange in the process after the breakdown rolling mill 70. In order to give reduction to the edge portions of the flange, it is necessary to provide the edger rolling mill 72. Therefore, the equipment cost is raised and, further, the length of the rolling line is extended.

On the other hand, Japanese Unexamined Patent Publication No. 4-251603 discloses a universal rolling mill in which rollers for reducing the flange width are arranged on both sides of the upper and the lower horizontal roller. In this rolling mill, the following three reduction processes are simultaneously conducted.

(1) Reduction of the web of the H-beam conducted by the outer circumferential face of the horizontal roller (2) Reduction of the external faces of the flanges of the H-beam conducted between the vertical rollers arranged on both sides of the horizontal rollers (3) Reduction of the flange width of the H-beam conducted by the width reduction rollers arranged on both sides of the horizontal rollers Since the above three processes are simultaneously conducted, it is necessary to arrange a pair of flange width reduction rollers in a gap formed by a pair of right and left vertical rollers and a pair of upper and lower horizontal rollers. However, this gap is so small that it is difficult to ensure the thickness of the disk-shaped flange width reduction rollers. Accordingly, it is impossible to ensure the mechanical strength of the rollers. For the above reasons, it is difficult to put the above universal rolling mill into practical use.

On the other hand, from the viewpoint of product quality, the above universal rolling mill has the following disadvantages. Since it is difficult to make the gap between the vertical rollers and the horizontal rollers agree with the thickness of the flange width reduction rollers, when the flange width reduction rollers are thick, the rollers interfere with each other, and it is impossible to reduce the thickness of the flange of the H-beam to a predetermined value. On the contrary, when the flange width reduction rollers are thin, it is impossible to apply reduction to the overall face of the flange end of the H-beam. Accordingly, recesses are formed on the end faces of the flanges of the H-beam, which deteriorate the product quality.

Further, the universal rolling mill described in Japanese Unexamined Patent Publication No. 4-251603 is disadvantageous in that the number of the rolling mills can not be decreased and the length of the rolling line can not be shortened, that is, the equipment cost can not be decreased. In other words, it is impossible to accomplish the object of the present invention by the universal rolling mill described in Japanese Unexamined Patent Publication No. 4-251603 .

It is an object of the present invention to provide a multifunction rolling mill for rolling an H-beam, the dimensional accuracy of which is high, and also provide a rolling method of rolling an H-beam with the multifunction rolling mill when the number of the rolling mills, which is at least three for conducting intermediate and finish rolling by the prior art, is decreased to two so that the equipment cost can be reduced and at the same time the length of the line can be shortened so as to reduce the length of the building in which the rolling apparatus is installed.

SUMMARY OF THE INVENTION

The present invention described in claim 1 provides a multifunction rolling mill for rolling an H-beam comprising: a pair of right and left vertical rollers composed of flange thickness reduction rollers; and a pair of upper and lower horizontal rollers having web thickness reduction rolling section and flange width reduction rolling section which are capable of freely moving in the vertical direction and arranged via a retracting mechanism arranged at both ends of the web thickness reduction rollers, wherein the flange width reduction rolling section of the horizontal rollers is moved in the vertical direction when the flange thickness reduction and the web thickness reduction are conducted by the vertical roller and the horizontal rollers so that the flange width reduction rolling section of the horizontal rollers cannot interfere with the vertical rollers.

The present invention described in claim 2 provides a multifunction rolling mill for rolling an H-beam according to claim 1, wherein both reduction faces of the flange width reduction rolling section are formed into annular tapered faces, the diameters of which are gradually symmetrically decreased toward the centers of the flange thickness reduction rollers.

In the multifunction rolling mill for rolling an H-beam described in claims 1 and 2, not only the web thickness reducing rolling section for reducing the web of the H-beam and the flange thickness reducing rollers for reducing the external side face of the flanges of the H-beam but also the flange width reducing rolling section for reducing the flange edge section of the H-beam is integrally incorporated into the rolling mill, and the flange width reducing rolling section can be moved between the reducing position and the retracting position by the retracting mechanism.

Accordingly, the number of the rolling mills, which is at least three in the rolling apparatus of the prior art, can be decreased to two. As a result, the length of the building can be decreased and also the length of the foundation can be decreased, that is, the equipment cost of the rolling apparatus for rolling the H-beam can be lowered.

It is possible to adopt a rolling pass schedule in which universal rough rolling is conducted by both the multifunction rolling mill and the universal rough rolling mill. Therefore, the number of passes in the universal rolling line can be decreased, so that the productivity can be enhanced.

Further, the vertical position of the flange width reducing rolling section can be changed with respect to the web thickness reducing rolling section. Therefore, the lengths of the four flanges of the H-beam can be made equal to each other and deviation of the web can be decreased, that is, it is possible to roll an H-beam, the dimensional accuracy of which is high.

In the multifunction rolling mill for rolling an H-beam according to claim 2, both reduction faces of the flange width reduction rolling section are formed into annular tapered faces, the diameters of which are gradually symmetrically decreased toward the centers of the flange thickness reduction rollers. Therefore, even when the multifunction rolling mill is arranged on the upstream side of the universal rough rolling mill, it is possible to positively conduct universal finish rolling, edging rolling and universal rough rolling with the multifunction rolling mill.

The present invention described in claim 3 provides a rolling method of rolling an H-beam with a multifunction rolling mill, in which the multifunction rolling mill, having a universal finish rolling function and an edging rolling function, is arranged on the upstream side or the downstream side of a universal rough rolling mill having a function of universal rough rolling, comprising the steps of conducting universal rough rolling, edging rolling and universal finish rolling while a piece of work to be rolled is being reciprocated between the universal rough rolling mill and the multifunction rolling mill, wherein the universal rough rolling can be also conducted by the multifunction rolling mill.

According to the present invention described in claim 3, universal rough rolling is conducted by both the multifunction rolling mill and the universal rough rolling mill, and reduction is given to both the web and the flange of an H-beam so as to reduce the thickness. Due to the foregoing, the number of passes in the universal line can be decreased and the productivity can be greatly enhanced.

The present invention described in claim 4 provides a rolling method of rolling an H-beam with a multifunction rolling mill including a pair of right and left vertical rollers composed of flange thickness reduction rollers and also including a pair of upper and lower horizontal rollers having web thickness reduction rolling section and flange width reduction rolling section capable of freely moving in the vertical direction and arranged via a retracting mechanism arranged at both ends of the web thickness reduction rolling section, the rolling method of rolling an H-beam with a multifunction rolling mill comprising the steps of: conducting web thickness rolling of the H-beam with the web thickness reduction rolling section of the horizontal rollers and also conducting flange width rolling of the H-beam with the flange width reduction rolling section arranged on both sides of the horizontal rollers under the condition that the right and left vertical rollers are retracted to positions where the right and left vertical rollers do not interfere with the upper and lower flange width reduction rolling section when edging rolling is conducted on the H-beam, and conducting web thickness rolling on the H-beam with the web thickness reduction rolling section arranged at the horizontal rollers and also conducting flange thickness rolling on the H-beam with the vertical rollers under the condition that the right and the left flange width reduction rolling section arranged at the horizontal rollers are retracted to positions where the right and the left flange width reduction rolling section do not interfere with the right and the left vertical roller when universal rolling is conducted on the H-beam.

Due to the foregoing, the flange width reduction rolling section and the right and left vertical rollers do not interfere with each other. Therefore, both universal rolling and edging rolling can be smoothly carried out without causing any problem, and an H-beam which suits to the actual rolling operation can be produced. Accordingly, it is possible to produce an H-beam the dimensional accuracy of which is higher than that of the rolling method of the prior art.

DESCRIPTION OF THE MOST PREFERRED EMBODIMENT

By referring to the appended drawings, specific embodiments of the present invention will be explained as follows.

Referring to FIGS. 1 to 5, the multifunction rolling mill 11 used for the rolling apparatus, for rolling an H-beam, of the first embodiment of the present invention will be explained below.

Figure 1:
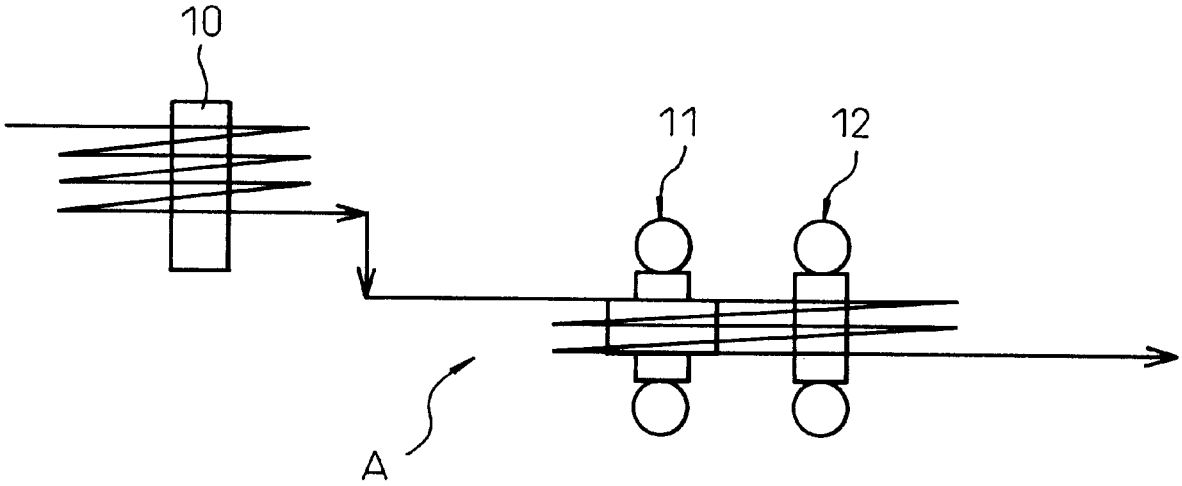
FIG. 1 is a conceptual arrangement view showing an arrangement of a rolling apparatus, for rolling an H-beam, having a multifunction rolling mill of an embodiment of the present invention.

FIG. 1 is a conceptual view showing an overall arrangement of rolling apparatus A, for rolling an H-beam, including the multifunction rolling mill 11 used for the rolling apparatus of the first embodiment of the present invention.

As shown in the drawing, rolling apparatus A for rolling an H-beam includes: a breakdown rolling mill 10; a multifunction rolling mill used for the rolling apparatus for rolling an H-beam; and a universal rough rolling mill 12, wherein these rolling mills are arranged in series. In this case, the breakdown rolling mill 10 is used for roughly forming a piece of material to be rolled such as a slab or beam blank into an H-shaped piece. Although not shown in the drawing, the breakdown rolling mill 10 includes a pair of breakdown rollers.

Figure 31:
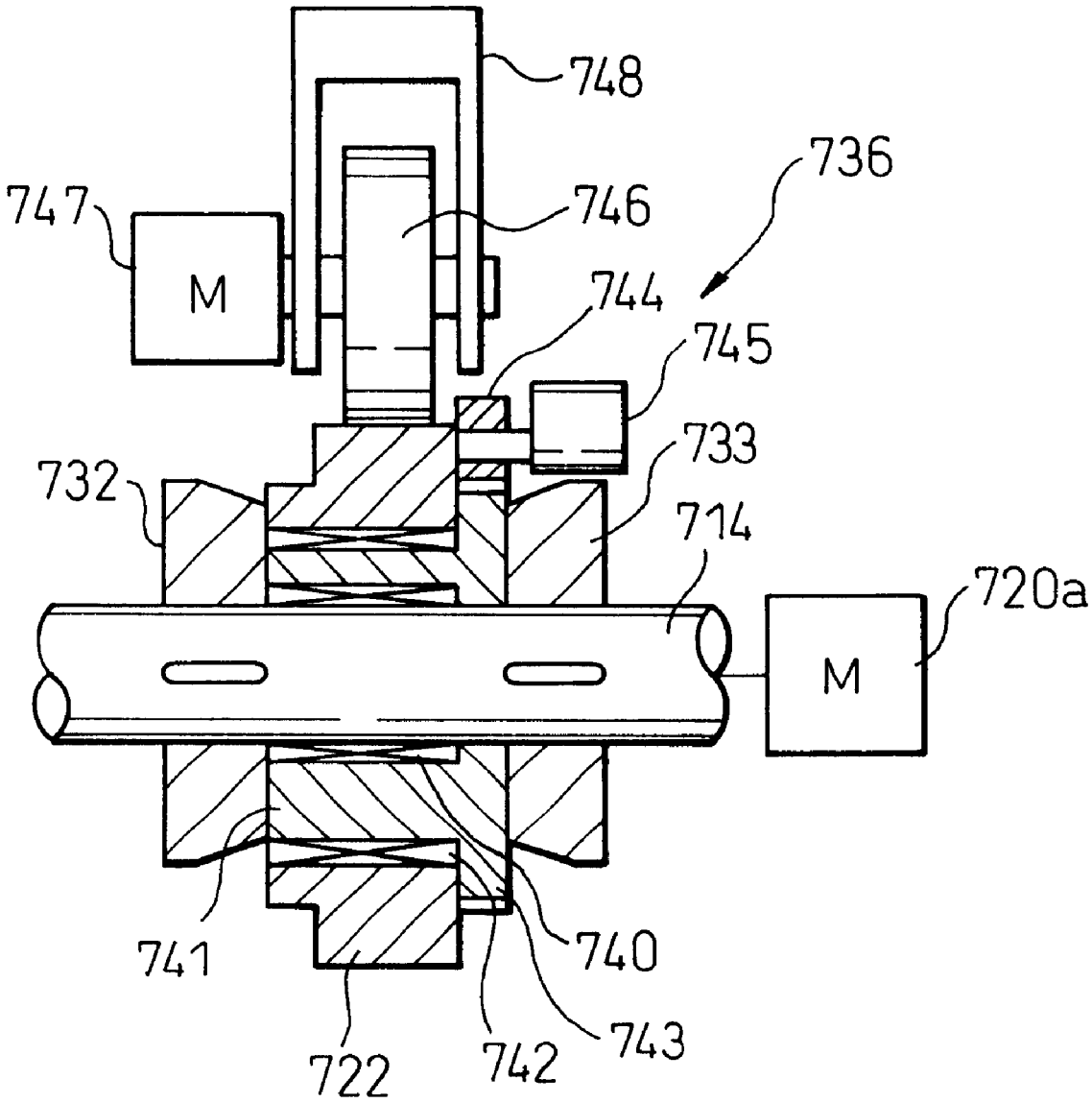
FIG. 31 is a partially enlarged cross-sectional view in which a portion of the multifunction rolling mill shown in FIG. 30 is enlarged.

As shown in FIG. 31 the universal rough rolling mill 12 includes: web thickness reduction rollers 12*a*, 12*b* for roughly rolling the web 13*a* of the H-beam 13; and flange thickness reduction rollers 12*c*, 12*d* for roughly rolling the flange 13*b*, wherein rolling is conducted by means of universal rolling by the universal rough rolling mill 12.

As the details will be described later referring to FIGS. 2, 4 and 5, the multifunction rolling mill 11 includes: a pair of upper and lower rollers 22, 23 for reducing the web thickness by which the finish thickness of the web 13*a* of the H-beam 13 is determined; a pair of right and left rollers 30, 31 for reducing the flange thickness by which the finish thickness of the flange 13*b* of the H-beam 13 is determined; and rollers 32, 33, 34, 35 for reducing the flange width by which the flange edge portions of the H-beam 13 are reduced. A pair of right and left vertical rollers are composed of the flange thickness reduction rollers 30, 31, and a pair of upper and lower horizontal rollers are composed of the web thickness reduction rollers 22, 23 and the flange width reduction rollers 32 to 35. However, as described later, in this embodiment, the web thickness reduction rollers 22, 23 and the flange thickness reduction rollers 30, 31 are used not only for universal finish rolling but also for universal rough rolling.

Figure 2:
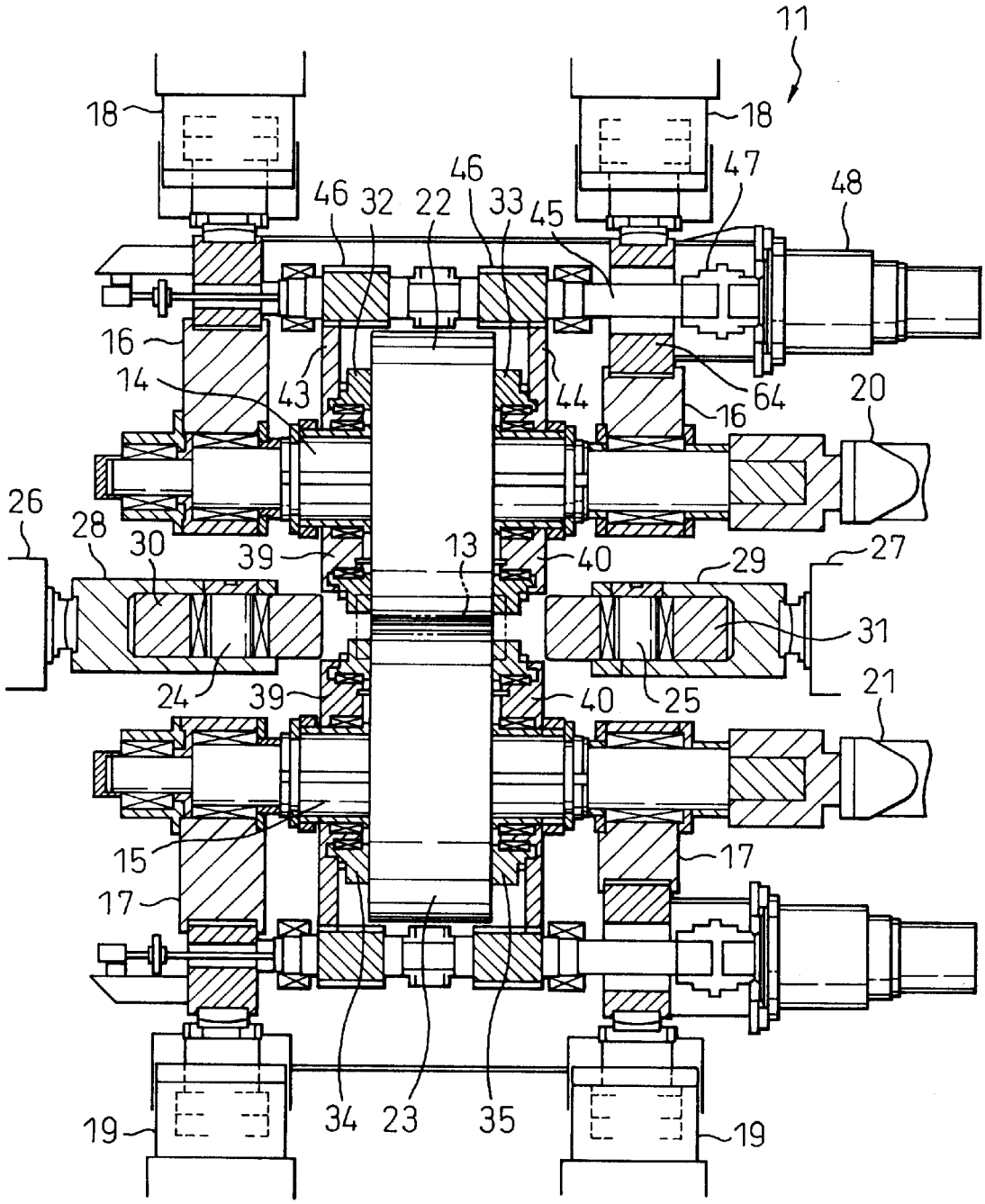
FIG. 2 is a cross-sectional side view of a multifunction rolling mill used for a rolling apparatus, for rolling an H-beam, of the first embodiment of the present invention.

As shown in FIG. 2, the horizontal roller shafts 14, 15 are arranged right above and right below the H-beam 13 which is a piece of work to be rolled by the multifunction rolling mill 11. Both end portions of the horizontal roller shafts 14, 15 are pivotally supported by the upper and lower horizontal roller chocks 16, 17. The upper horizontal roller chocks 16 and the lower horizontal roller chocks 17 are respectively moved in the vertical direction by the upper horizontal roller screw down device 18 and the lower horizontal roller screw down device 19 independently from each other. One end of each horizontal roller shaft 14, 15 is connected with a horizontal roller shaft drive motor (not shown) via the universal joint 20, 21.

As shown in FIG. 2, each web thickness reduction roller 22, 23 is attached to a center of each horizontal roller shaft 14, 15. When flat outer circumferential faces of the web thickness reduction rollers 22, 23 are pressed against an upper and a lower face of the web of the H-beam 13, it is possible to set the finish web thickness of the H-beam 13 and conduct universal rough rolling. In this connection, it is preferable that the web thickness reduction rollers 22, 23 are engaged with the horizontal roller shafts 14, 15 by means of shrinkage fitting. The web thickness reduction rollers 22, 23 and the horizontal roller shafts 14, 15 may be composed integrally with each other.

On the other hand, as shown in FIG. 2, on both sides of the H-beam 13, the vertical rollers 24, 25 are arranged and attached to the vertical roller chocks 28, 29. The flange thickness reduction rollers 30, 31 are pivotally supported by the vertical roller shafts 24, 25. The vertical roller chocks 28, 29 can be freely positioned in the horizontal direction by the vertical roller screw down devices 26, 27. When the flat outer circumferential faces of the flange thickness reduction rollers 30, 31 are pressed against the external sides of the flanges of the H-beam 13, the finish flange thickness of the H-beam 13 can be determined, and further it is possible to conduct universal rough rolling on the H-beam 13.

In this embodiment, as shown in FIG. 2, at the respective centers of the horizontal roller shafts 14, 15, on both sides of the web thickness reduction rollers 22, 23, there are provided flange width reduction rollers 32, 33, 34, 35 which are edger rolling rollers for reducing the side edge portions of the flanges of the H-beam 13.

Figure 6:
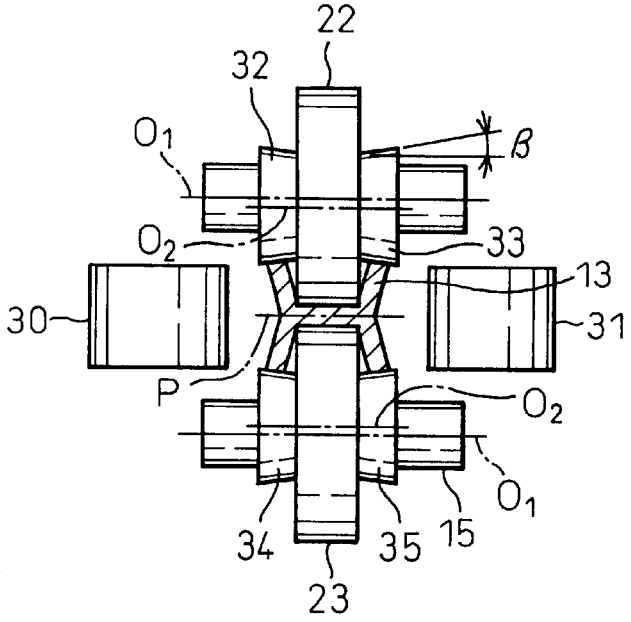
FIG. 6 is a schematic illustration for explaining movements of a flange width reducing rolling section of a multifunction rolling mill used for a rolling apparatus, for rolling an H-beam, of an embodiment of the present invention.
Figure 7:
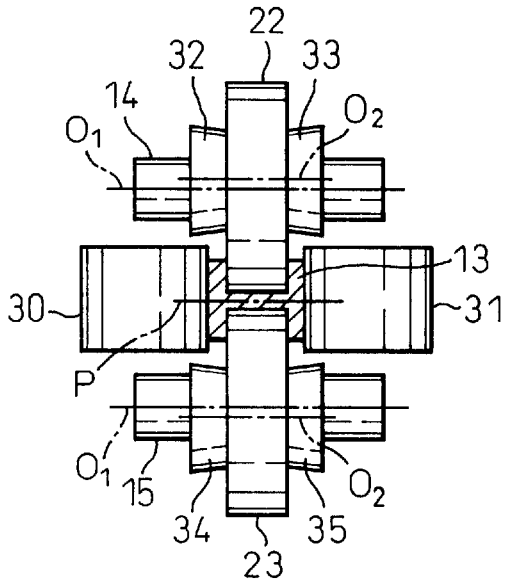
FIG. 7 is a schematic illustration for explaining movements of a flange width reducing rolling section of a multifunction rolling mill used for a rolling apparatus, for rolling an H-beam, of an embodiment of the present invention.

As shown in FIG. 6, when the end portions of the flanges of the H-beam 13 are reduced, the flange width reduction rollers 32, 33, 34, 35 are located at the reduction positions which proceed to pass line P of the H-beam 13. On the other hand, when the finish web thickness of the H-beam 13 is determined by the web thickness reduction rollers 22, 23 and also when the finish flange thickness of the H-beam 13 is determined by the flange thickness reduction rollers 30, 31 and also when universal rough rolling is conducted on the H-beam 13, the flange width reduction rollers 32, 33, 34, 35 are easily and positively retracted to the retracting positions by the roller retracting mechanism 36, which is illustrated in FIG. 4, as shown in FIG. 7. Therefore, there is no possibility that the flange width reduction rollers 32, 33, 34, 35 interfere with the web thickness reduction rollers 22, 23 and the flange thickness reduction rollers 30, 31, that is, there is no possibility that the rolling action is blocked.

Figure 4:
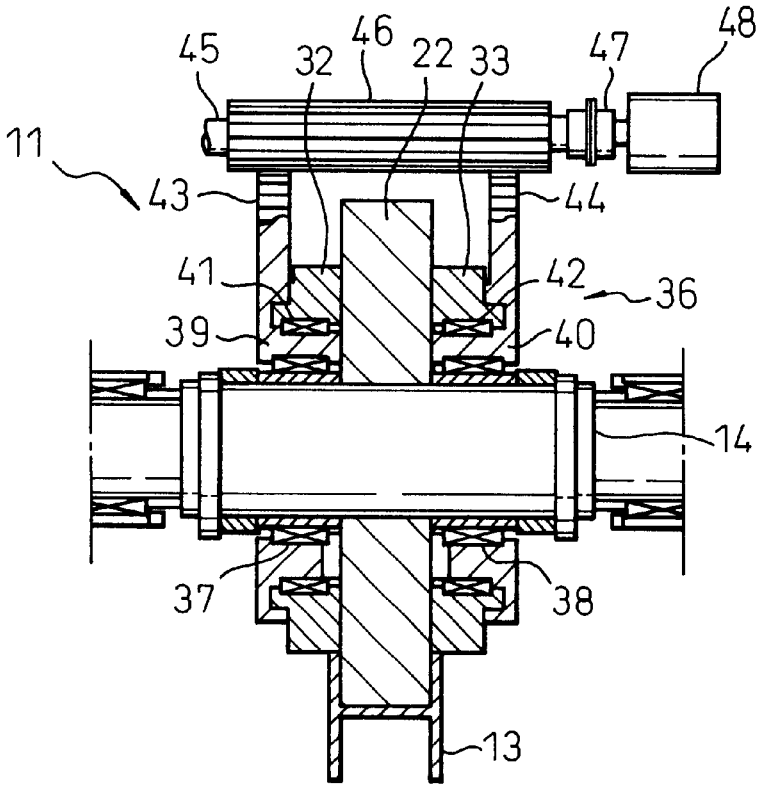
FIG. 4 is a cross-sectional side view of a roller retracting mechanism of a multifunction rolling mill used for a rolling apparatus, for rolling an H-beam, of an embodiment of the present invention.
Figure 5:
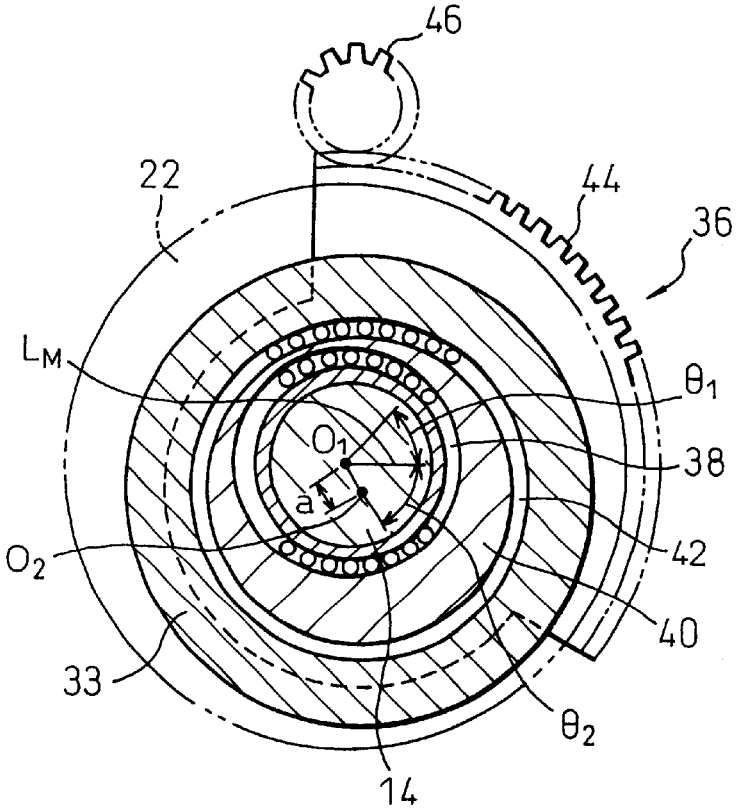
FIG. 5 is a front view of a roller retracting mechanism.

Referring to FIGS. 2, 4 and 5, the roller retracting mechanism 36 includes: eccentric rings 39, 40 engaged with the upper horizontal roller shaft 14 via the inside bearings 37, 38 on both sides of the web thickness reduction roller 22; and the flange width reduction rollers 32, 33 engaged with the outer circumferential faces of the eccentric rings 39, 40 via the outside bearings 41, 42. Referring to FIG. 5, each eccentric ring 39, 40 has a bore, the center of which is O1, and an outer circumferential face, the center of which is O2 which is eccentric from center O1 by distance "a". The upper horizontal roller shaft 14 is inserted into the bore. Accordingly, center O1 of the bore coincides with the center of the upper horizontal roller shaft 14. Further, the eccentric ring 39, 40 has a sector gear 43, 44 arranged by the central angle approximately 140° with respect to center O1. The sector gear 43, 44 is meshed with the pinion 46 arranged on the rotary shaft 45 which is pivotally attached to the elevating frame 64 shown in FIG. 2. One end of the rotary shaft 45 is connected with the eccentric ring drive actuator 48 via the joint 47. In this connection, the eccentric ring drive actuator 48 can be composed of an electric motor or a hydraulic motor.

Next, positioning of the flange width reduction rollers 32, 33 in the vertical direction, which is conducted by the roller retracting mechanism 36, will be explained as follows. In FIG. 5, reference characters are defined as follows. Neutral line LM is a straight line connecting center O1 with center O2 when center O2 is located at a horizontal position with respect to center O1. Rotary angle θ1 is a rotary angle with respect to center O1 when center O2 is located at an upper position of neutral line LM. Rotary angle θ2 is a rotary angle with respect to center O1 when center O2 is located at a lower position of neutral line LM.

When the eccentric ring drive actuator 48 is started, the rotary shaft 45 and the pinion 46 are rotated, and the sector gears 43, 44 meshed with the pinion 46 are rotated round center O1 of the upper horizontal roller shaft 14. Due to the foregoing, center 02 of the eccentric ring 39, 40 is revolved round center O1. At this time, the vertical position of center O2 with respect to neutral line LM is expressed by $a \cdot \sin \theta 1$ or $a \cdot \sin \theta 2$. Since the flange width reduction rollers 32, 33 are engaged with the outer circumferential faces of the eccentric rings 39, 40 via the outer bearings 41, 42, the vertical position of center O2 of the flange width reduction roller 32, 33 can be expressed by $a \cdot \sin \theta 1$ or $a \cdot \sin \theta 2$ in the same manner. As described above, the vertical positions of the flange width reduction rollers 32, 33 can be controlled by the eccentric ring drive actuator 48.

Figure 8:
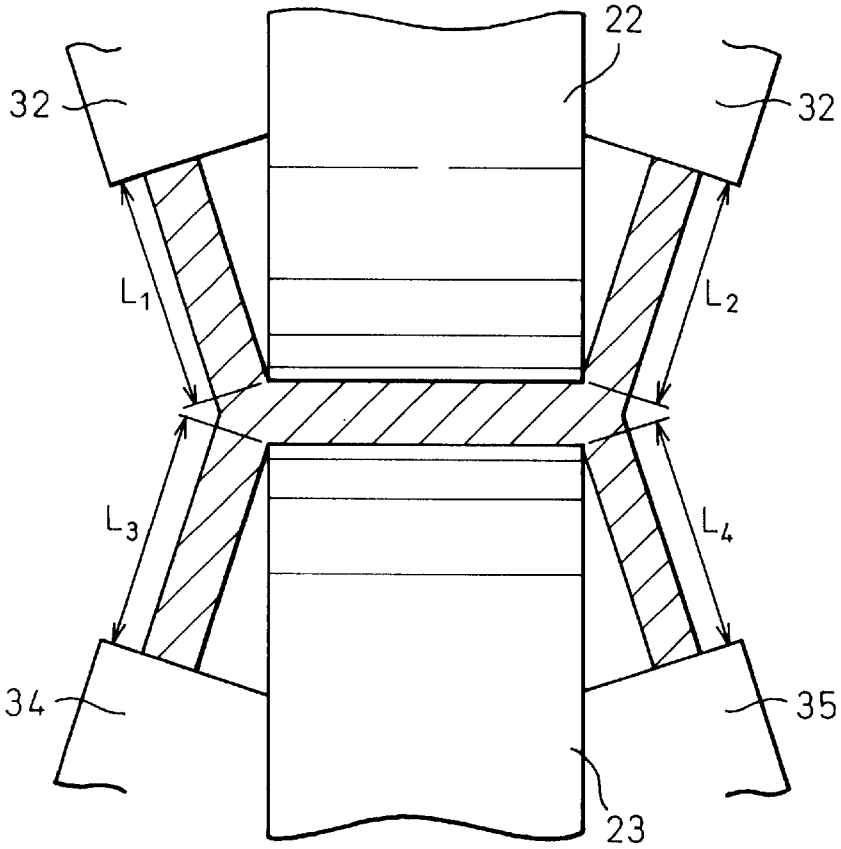
FIG. 8 is a schematic illustration for explaining movements of a flange width reducing rolling section of a multifunction rolling mill used for a rolling apparatus, for rolling an H-beam, of an embodiment of the present invention.

Due to the above structure, as shown in FIG. 8, the vertical positions of the flange width reduction rollers 32 to 35 can be adjusted relatively with respect to the positions of the web thickness reduction rollers 22, 23. Therefore, the rolling of the width edge portions of the H-beam 13 can be conducted simultaneously with the rolling of the web thickness. As a result, it becomes possible to make four lengths Li, L2, L3, L4 equal to each other. Accordingly, it becomes possible to conduct rolling in which deviation of the web is decreased. Due to the foregoing, it is possible to roll an H-beam 13, the dimensional accuracy of which is excellent.

Figure 9:
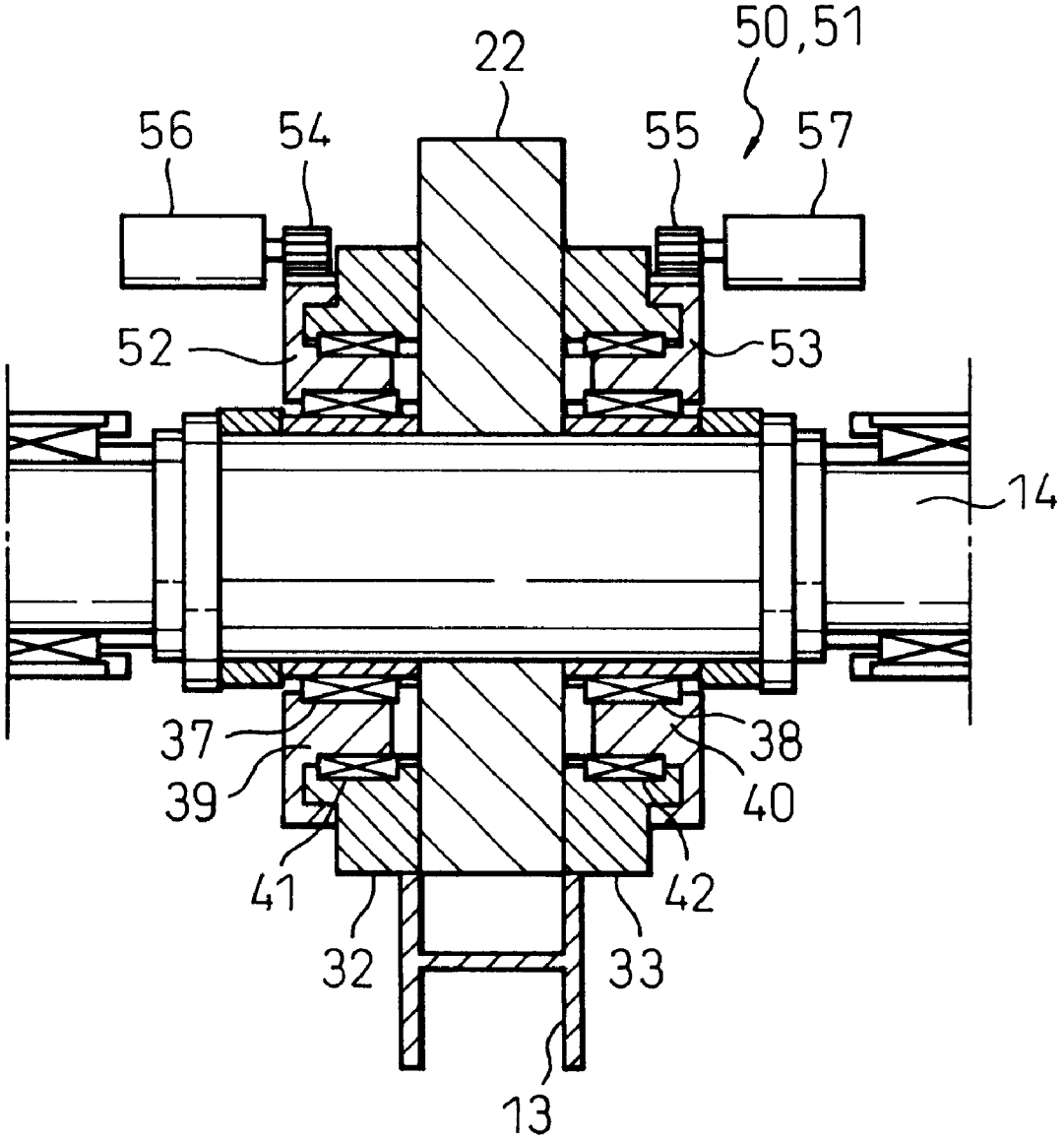
FIG. 9 is a cross-sectional side view of a variation of a roller retracting mechanism of a multifunction rolling mill used for a rolling apparatus, for rolling an H-beam, of an embodiment of the present invention.

FIG. 9 is a view showing a variation of the embodiment of the roller retracting mechanism. In this connection, like reference characters are used to indicate like parts in FIG. 9 and the drawings showing the embodiment described before.

The roller retracting mechanism 50 shown in FIG. 9 includes the rotary gears 52, 53 provided on the outer circumferential faces of the eccentric rings 39, 40, and the rotary gears 52, 53 are respectively meshed with the pinions 54, 55 attached to the rotary shafts of the eccentric ring drive actuators 56, 57 which are arranged independently from each other. Due to the above structure, the eccentric rings 39, 40 can be independently rotated. Therefore, the right and the left flange width of the H-beam 13 can be independently rolled while being controlled.

Figure 10:
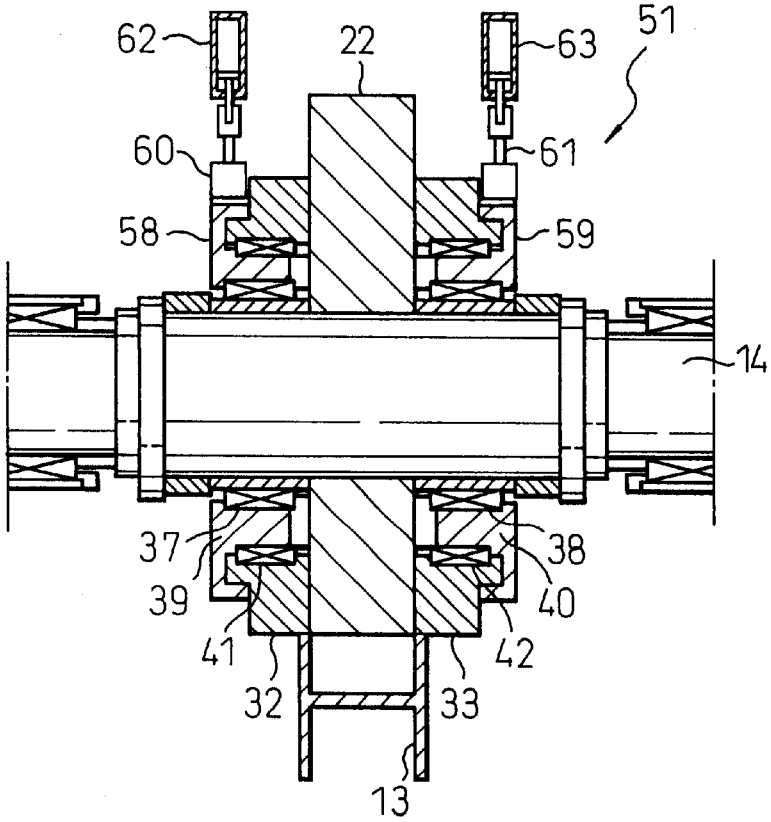
FIG. 10 is a cross-sectional side view of a variation of a roller retracting mechanism of a multifunction rolling mill used for a rolling apparatus, for rolling an H-beam, of an embodiment of the present invention.

FIG. 10 is a view showing still another variation of the embodiment of the roller retracting mechanism. In this connection, like reference characters are used to indicate like parts in FIG. 10 and the drawings showing the embodiment described before.

The roller retracting mechanism 51 shown in FIG. 10 includes rotary plates 58, 59 attached onto the outer circumferential faces of the eccentric rings 39, 40. The rotary plates 58, 59 are connected with the eccentric ring drive cylinders 62, 63 via the link mechanisms 60, 61.

Next, referring to FIGS. 1 to 13, especially referring to FIG. 11 in which the pass schedule is shown, the method of producing the H-beam 13 by the above multifunction rolling mill 11 will be explained as follows.

First, as shown in FIG. 1, a piece of material to be rolled such as a slab or a beam blank is roughly rolled by the breakdown rolling mill 10 so that the H-beam 13 can be formed.

Next, as shown in FIGS. 1 and 2, the H-beam 13 is transferred to the multifunction rolling mill 11 and subjected to the first universal rough rolling (H(UF-1)). At this time, as shown in FIG. 7, a pair of upper and lower web thickness reduction rollers 22, 23 are made to come close to each other by the upper horizontal roller screw down device 18 and the lower horizontal roller screw down device 19, so that the web is restricted by the web thickness reduction rollers 22, 23. Further, the flange thickness reduction rollers 30, 31 are moved inside by a reduction screw not shown in the drawing, so that the external sides of the flanges of the H-beam 13 are reduced. At this time, the eccentric ring actuator 48 is driven, so that the flange width reduction rollers 32, 33, 34, 35 are retracted by the retracting device 36.

Figure 3:
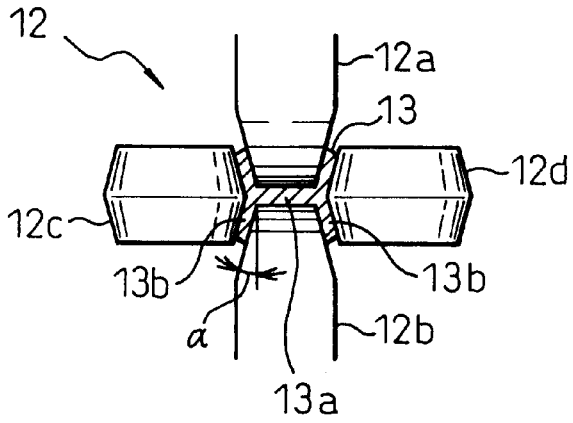
FIG. 3 is a schematic illustration for explaining a state of rolling by a universal rough rolling mill used for a rolling apparatus, for rolling an H-beam, having a multifunction rolling mill used for the rolling apparatus of an embodiment of the present invention.

Next, the H-beam 13 is transferred to the universal rough rolling mill 12, and the first universal rough rolling (X(UR-1)) and the second universal rough rolling (X(UR-2)) are carried out by the universal rough rolling mill 12. In this case, as shown in FIG. 3, the web thickness reduction rollers 12*a*, 12*b* of the universal rough rolling mill 12 and the flange thickness reduction rollers 12*c*, 12*d* respectively have a taper angle $\alpha$. Therefore, the flanges 13*b* of the H-beam 13 are expanded by the angle $\alpha$ with respect to a straight line perpendicular to the web 13*a*.

After that, the H-beam 13 is returned to the multifunction rolling mill 11 and subjected to the first edging rolling (E(UE-1)). As shown in FIG. 6, the web 13*a* is reduced by the pair of upper and lower web thickness reduction rollers 22, 23, and at the same time, the flange width reduction rollers 32, 33, 34, 35 are arranged by the retracting mechanism 36 at reduction positions which proceed to pass line P of the H-beam 13, so that the edging rolling is conducted on the flanges 13*b* of the H-beam 13. In this case, each flange thickness reduction roller 30, 31 has an annular tapered face, the diameter of which gradually decreases toward the center, so that the reduction faces of the flange width reduction rollers 32, 33, 34, 35 can be perpendicularly contacted with the flanges. It is preferable that taper angle $\beta$ of the annular tapered face is formed at 40° to 60°.

In the same manner as that described above, the second universal rough rolling (H(UF-2)) conducted by the multifunction rolling mill 11, the third universal rough rolling (X(UR-3)) conducted by the universal rough rolling mill 12, the fourth universal rough rolling (X(UR-4)) conducted by the universal rough rolling mill 12, the second edging rolling (E(UE-2)) conducted by the multifunction rolling mill 11, the third universal rough rolling (H(UF-3))conducted by the multifunction rolling mill 11, the fifth universal rough rolling (X(UR-5)) conducted by the universal rough rolling mill 12, the sixth universal rough rolling (X(UR-6)) conducted by the universal rough rolling mill 12, the third edging rolling (E(UE-3)) conducted by the multifunction rolling mill 11, and the fourth universal finish rolling (H(UF-4)) conducted by the multifunction rolling mill 11 are successively carried out. In this process of universal finish rolling, the flange thickness reduction rollers 30, 31 are moved inside by reduction screws not shown in the drawing, and the external faces of the flanges of the H-beam 13 are reduced. In this way, it is possible to roll the flanges which are formed at right angles with respect to the web.

As described above, according to this embodiment, when only two sets of rolling mills including the multifunction rolling mill 11 and the universal rough rolling mill 12 are used, it is possible to carry out universal rough rolling, edging rolling and universal finish rolling. In other words, according to this embodiment, the number of the rolling mills can be decreased, that is, according to the prior art, it is necessary to provide at least three rolling mills after the breakdown rolling mill 10, however, according to this embodiment, the number of the rolling mills can be decreased to two, and at the same time, the length of the building can be shortened and also the length of the foundation can be shortened. As a result, the equipment cost of the rolling apparatus for rolling H-beams can be decreased.

Figure 11:
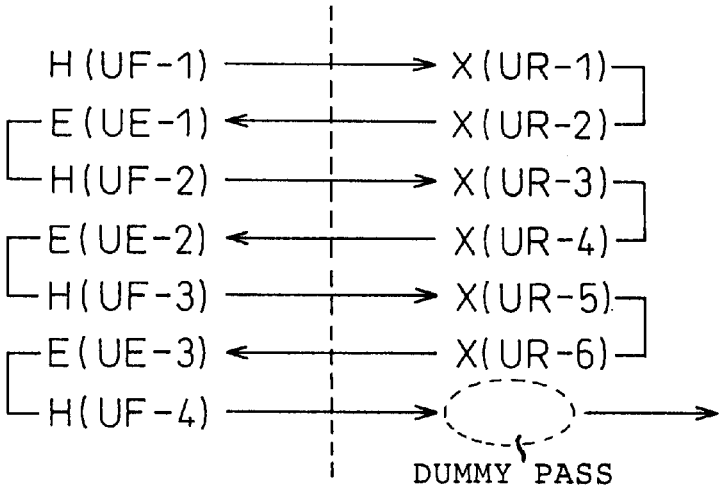
FIG. 11 is a schematic illustration for explaining a pass schedule of a multifunction rolling mill and a universal rough rolling mill used for a rolling apparatus, for rolling an H-beam, of an embodiment of the present invention.

In this embodiment, as can be seen in the pass schedule shown in FIG. 11, when universal rough rolling is applied to both the multifunction rolling mill 11 and the universal rough rolling mill 12 so as to give reduction to both the web and the flange of the H-beam 13 and decrease the thickness, rough rolling to be conducted in the universal line can be conducted by both the universal rough rolling mill 12 and the multifunction rolling mill 11. In this case the number of passes in the universal line can be decreased so as to enhance the productivity.

Figure 12:
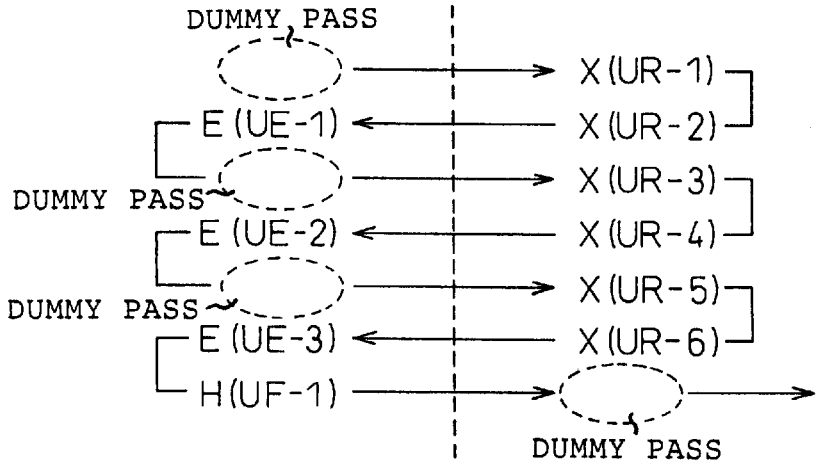
FIG. 12 is a schematic illustration for explaining a pass schedule of a multifunction rolling mill and a universal rough rolling mill used for a rolling apparatus, for rolling an H-beam, of an embodiment of the present invention.

In this connection, in the pass schedule shown in FIG. 11, one of the three passes of universal rough rolling (H(UF-1), H(UF-2), H(UF-3)) conducted by the multifunction rolling mill 11 can be replaced with edging rolling or dummy rolling by the function of the multifunction rolling mill 11. For example, in order to enhance the surface property of the product of the H-beam 13, the above three passes are made to be dummy rolling as shown in FIG. 12. As a result, surfaces of the universal finish rollers are not damaged, and the surface property of the product can be improved.

Figure 13:
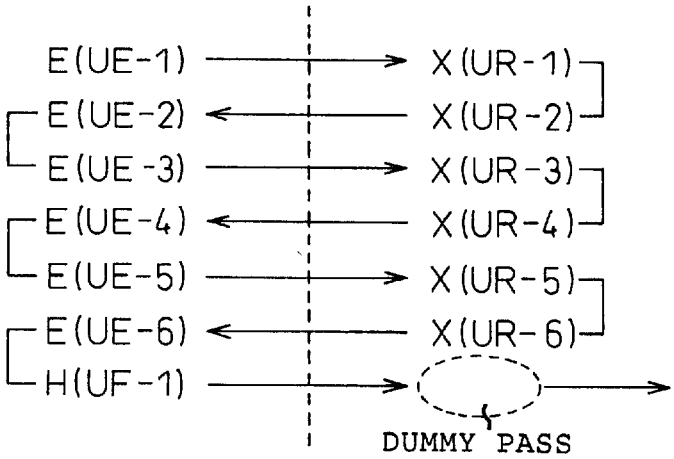
FIG. 13 is a schematic illustration for explaining a pass schedule of a multifunction rolling mill and a universal rough rolling mill used for a rolling apparatus, for rolling an H-beam, of an embodiment of the present invention.

On the other hand, in the case where the diameter of the edging roller is decreased so that the reaction force of edging can be lowered, as shown in FIG. 13, edging rolling is conducted in all the three passes, so that the edging load per one pass can be lowered.

Figure 14:
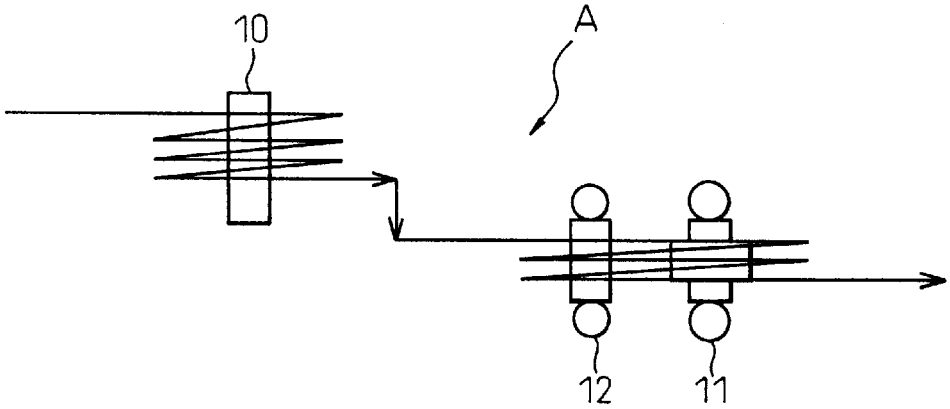
FIG. 14 is a conceptual arrangement view showing an overall arrangement of a rolling apparatus, for rolling an H-beam, having a multifunction rolling mill of an embodiment of the present invention in the case where the multifunction rolling mill is arranged on the downstream side and the universal rough rolling mill is arranged on the upstream side.
Figure 15:
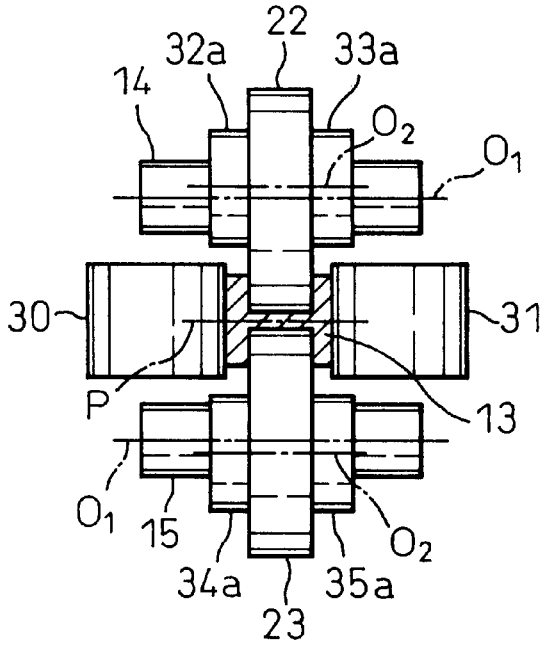
FIG. 15 is a schematic illustration for explaining movements of a flange width reduction rolling section of the above multifunction rolling mill.
Figure 16:
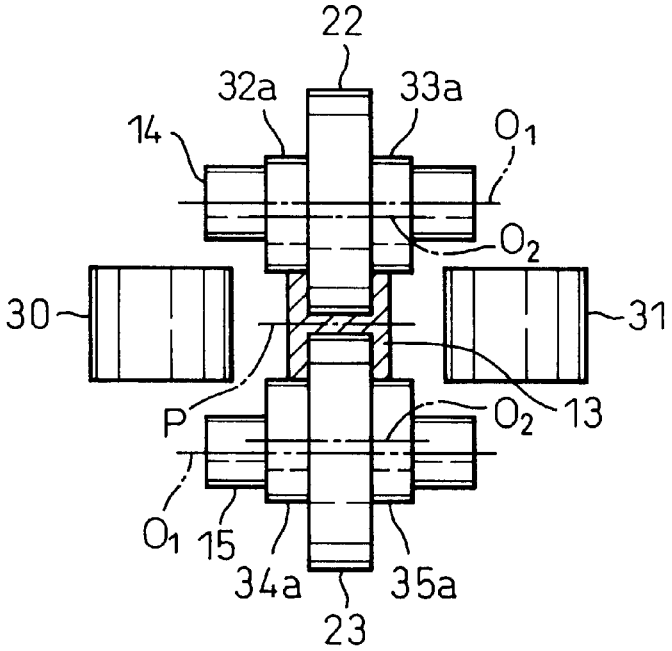
FIG. 16 is a schematic illustration for explaining movements of a flange width reduction rolling section of the above multifunction rolling mill.

As shown in FIG. 14, it is possible to arrange the multifunction rolling mill 11 at the back of the universal rough rolling mill 12, that is, 14, it is possible to arrange the multifunction rolling mill 11 on the downstream side of the universal rough rolling mill 12. In this case, the taper angles of the flange width reduction rollers 32*a*, 33*a*, 34*a*, 35*a* of the multifunction rolling mill 11 are set at 0° as shown in FIGS. 15 and 16.

Figure 17:
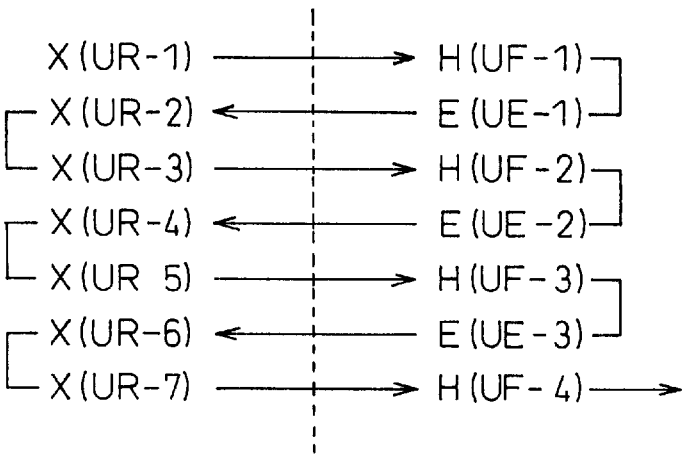
FIG. 17 is a schematic illustration for explaining a pass schedule of the above multifunction rolling mill and the universal rough rolling mill used for the rolling apparatus for rolling an H-beam.

In this case, the pass schedule of the multifunction rolling mill 11 can be set as shown in FIG. 17. The first universal rolling (X(UR-1)) conducted by the universal rough rolling mill 12, the first universal rough rolling (H(UF-1)) conducted by the multifunction rolling mill 11, the first edging rolling (E(UF-1)) conducted by the multifunction rolling mill 11, the second universal rough rolling (X(UR-2)) conducted by the universal rough rolling mill 12, the third universal rough rolling (X(UR-3)) conducted by the universal rough rolling mill 12, the second universal rough rolling (H(UF-2)) conducted by the multifunction rolling mill 11, the second edging rolling (E(UF-2)) conducted by the multifunction rolling mill 11, the fourth universal rough rolling (X(UR-4)) conducted by the universal rough rolling mill 12, the fifth universal rough rolling (X(UR-5)) conducted by the universal rough rolling mill 12, the third universal rough rolling (H(UF-3)) conducted by the multifunction rolling mill 11, the third edging rolling (E(UF-3)) conducted by the multifunction rolling mill 11, the sixth universal rough rolling (X(UR-6)) conducted by the universal rough rolling mill 12, the seventh universal rough rolling (X(UR-7)) conducted by the universal rough rolling mill 12, and the fourth universal finish rolling (H(UF-4)) conducted by the multifunction rolling mill 11 are carried out.

Figure 18:
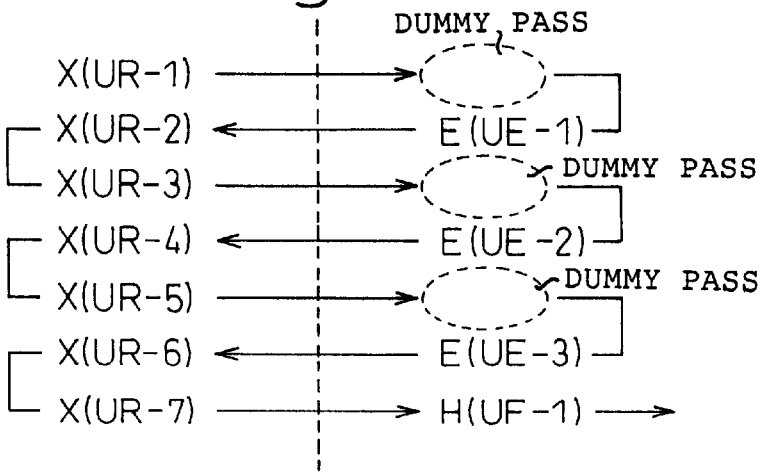
FIG. 18 is a schematic illustration for explaining a pass schedule of the above multifunction rolling mill and the universal rough rolling mill used for the rolling apparatus for rolling an H-beam.
Figure 19:
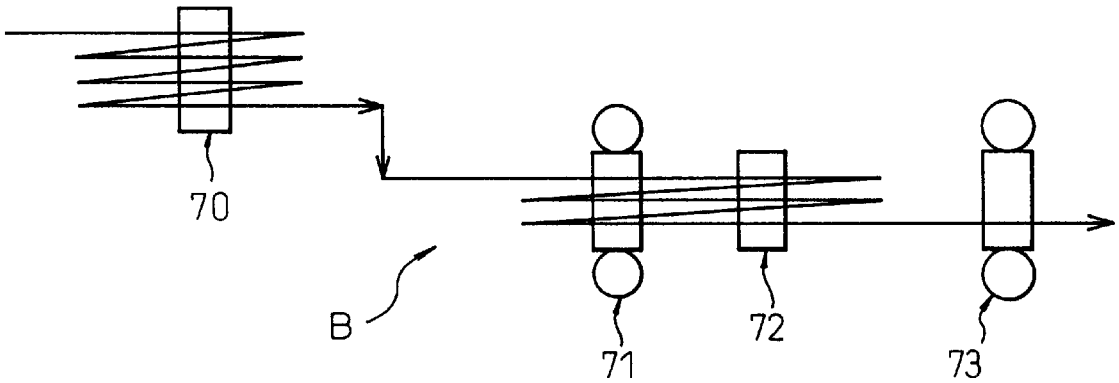
FIG. 19 is a conceptual schematic illustration for explaining an arrangement of a rolling apparatus, for rolling an H-beam, of the prior art.
Figure 20:
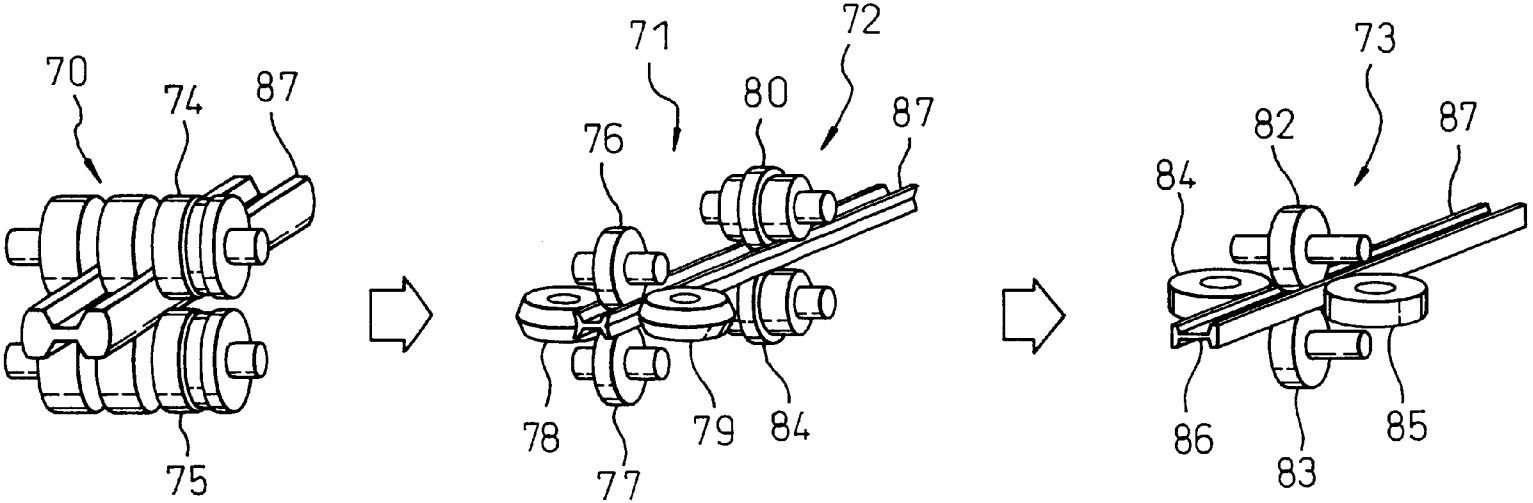
FIG. 20 is a perspective view of each rolling mill of a rolling apparatus, for rolling an H-beam, of the prior art.

In this case, in the pass schedule shown in FIG. 17, one of the three passes of (H(UF-1), H(UF-2), H(UF-3)) may be a dummy rolling as shown in FIG. 18 so as to enhance the surface property of the product of the H-beam 13.

Next, referring to FIGS. 21 and 22, the multifunction rolling mill 211 of the second embodiment of the present invention will be explained below.

Figure 21:
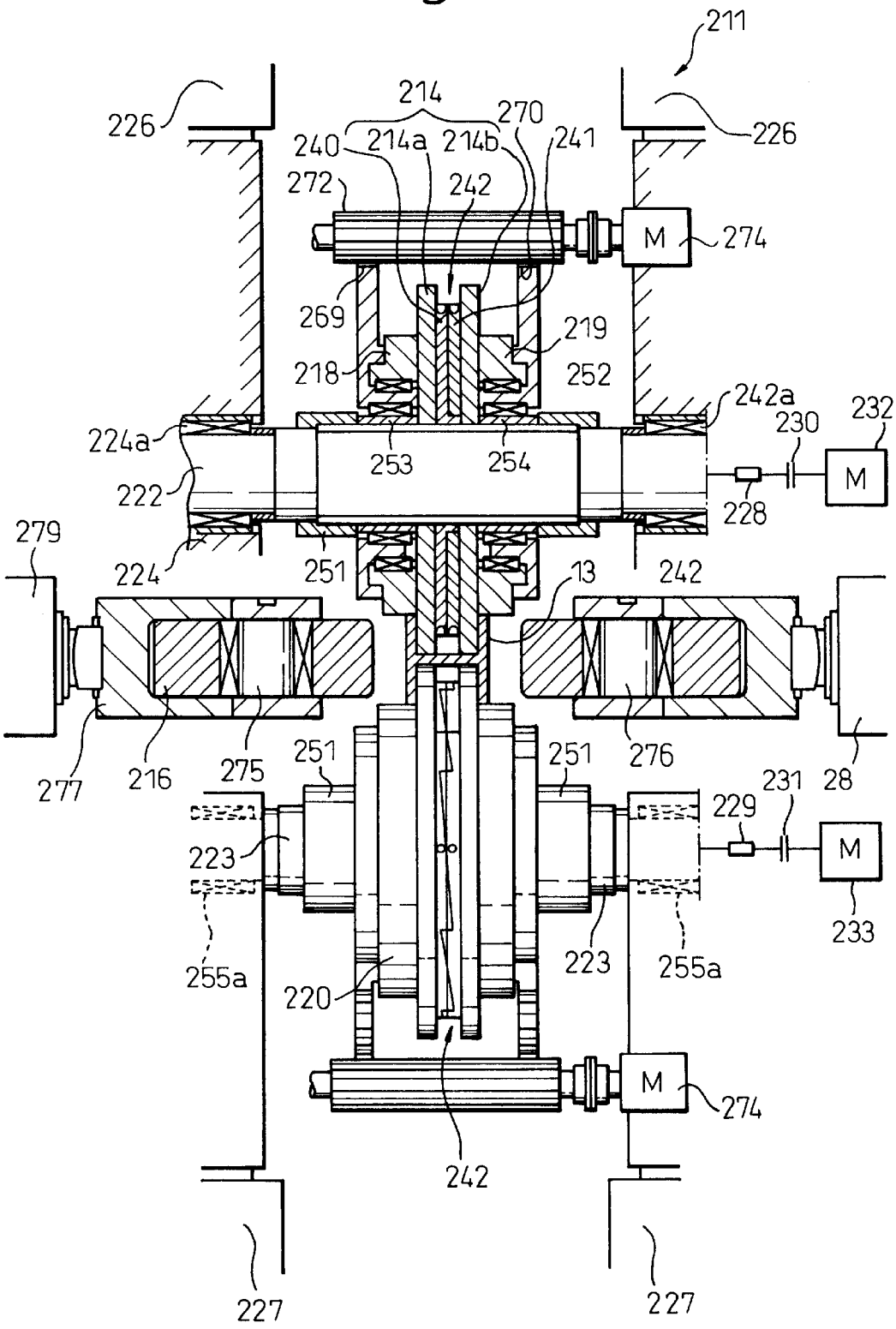
FIG. 21 is a cross-sectional side view of a multifunction rolling mill used for a rolling apparatus, for rolling an H-beam, of the second embodiment of the present invention.

Referring to FIG. 21, the multifunction rolling mill 211 includes: a pair of upper and lower web reduction rollers 214, 215 for setting the finish web thickness by giving reduction onto the upper and the lower face of the web 13*a* of the H-beam 13; a pair of right and left flange thickness reduction rollers 216, 217 for setting the finish flange thickness by applying reduction to the external faces of the H-beam 13; and a pair of upper and lower flange width reduction rollers 218, 219, 220, 221 for applying reduction to the side edge portions of the flanges of the H-beam 13. The upper web thickness reduction roller section 214 is composed of the first 214*a* and the second web thickness reduction roller section 214*b*, and the lower web thickness reduction roller section 215 is composed of the third 215*a* and the fourth web thickness reduction roller section 215*b*.

In this case, a pair of right and left vertical rollers are composed of the flange thickness reduction rollers 216, 217, and a pair of upper and lower horizontal rollers are composed of the web thickness reduction roller sections 214, 215 and the flange width reduction roller sections 218 to 221 arranged on both sides of the web thickness reduction roller sections 214, 215. However, in this second embodiment of the present invention, as described later, the web thickness reduction roller sections 214, 215 and the flange thickness reduction rollers 216, 217 are used for not only universal finish rolling but also universal rough rolling.

As shown in FIG. 21, there are provided horizontal roller shafts 222, 223 right above and right below the H-beam 13 which is a piece of work to be rolled inserted into the multifunction rolling mill 211. Both end portions of the horizontal roller shafts 222, 223 are pivotally supported by the horizontal roller chocks 224, 225 via the bearings 224*a*, 225*a*. The horizontal roller chocks 224, 225 are attached to the screw down devices 226, 227 and moved in the vertical direction relatively independently from each other. End portions of the horizontal roller shafts 222, 223 are connected with the horizontal roller shaft rotating motors 232, 233 via the spline joints 228, 229 and the universal joints 230, 231.

On the outer circumferential face of the upper horizontal roller shaft 222, there is provided a spline not shown in the drawing. The first web thickness reduction roller section 214*a* on the work side and the second web thickness reduction roller section 214*b* on the drive side have spline grooves, which are engaged with the spline of the upper horizontal roller shaft 222, on their inner circumferential faces. The first 214*a* and the second web thickness reduction roller section 214*b* are fixed to the upper horizontal roller shaft 222 leaving a predetermined interval in the axial direction between them. Due to the above spline engagement, the first 214*a* and the second web thickness reduction roller section 214*b* are rotated together with the upper horizontal roller shaft 222 and moved in the axial direction on the outer circumferential face of the upper horizontal roller shaft 222.

In the same manner as that described above, the lower horizontal roller shaft 223 is connected with the third 215*a* and the fourth web thickness reduction roller section 215*b* by spline engagement, and the third 215*a* and the fourth web thickness reduction roller section 215*b* are rotated together with the lower horizontal roller shaft 223 and moved in the axial direction on the outer circumferential face of the lower horizontal shaft 223.

When the horizontal roller shafts 222, 223 are rotated by driving the horizontal roller shaft drive motors 232, 233, the first to the fourth web thickness reduction roller sections 214*a*, 214*b*, 215*a*, 215*b* are rotated together with the horizontal roller shafts 222, 223. When the flat outer circumferential faces of the first to the fourth web thickness reduction rollers sections 214*a*, 214*b*, 215*a*, 215*b* are contacted with and pressed against the upper and the lower face of the web of the H-beam 13, the finish web thickness of the H-beam 13 can be set and universal rough rolling can be carried out.

The first to the fourth web thickness reduction rollers sections 214*a*, 214*b*, 215*a*, 215*b* are slidably engaged with the horizontal roller shafts 222, 223. Therefore, when a roller width adjustment mechanism, which will be explained later, is driven, width of the web thickness reduction roller sections 214, 215 can be arbitrarily adjusted according to the size of the H-beam 13, that is, roller width W can be arbitrarily adjusted according to the size of the H-beam 13. The first 214*a* and the second web thickness reduction roller section 214*b* will be explained as follows.

As shown in FIG. 21, between the first 214*a* and the second web thickness reduction roller section 214*b*, there is provided a width adjustment ring 242 having a stationary wedge ring 240 and a movable wedge ring 241. The stationary wedge ring 240 has spline grooves, which are engaged with the spline of the upper horizontal roller shaft 222, on the inner circumferential face. Due to the above spline engagement, the stationary wedge ring 240 can be rotated together with the upper horizontal roller shaft 222 and moved in the axial direction on the outer circumferential face of the upper horizontal roller shaft 222. On the other hand, the movable wedge ring 241 has a central opening portion not shown in the drawing. When this central opening portion is engaged with a complementary boss (not shown) formed on the stationary wedge ring 240, the movable wedge ring 241 is relatively pivotally connected with the stationary wedge ring 240.

Figure 22:
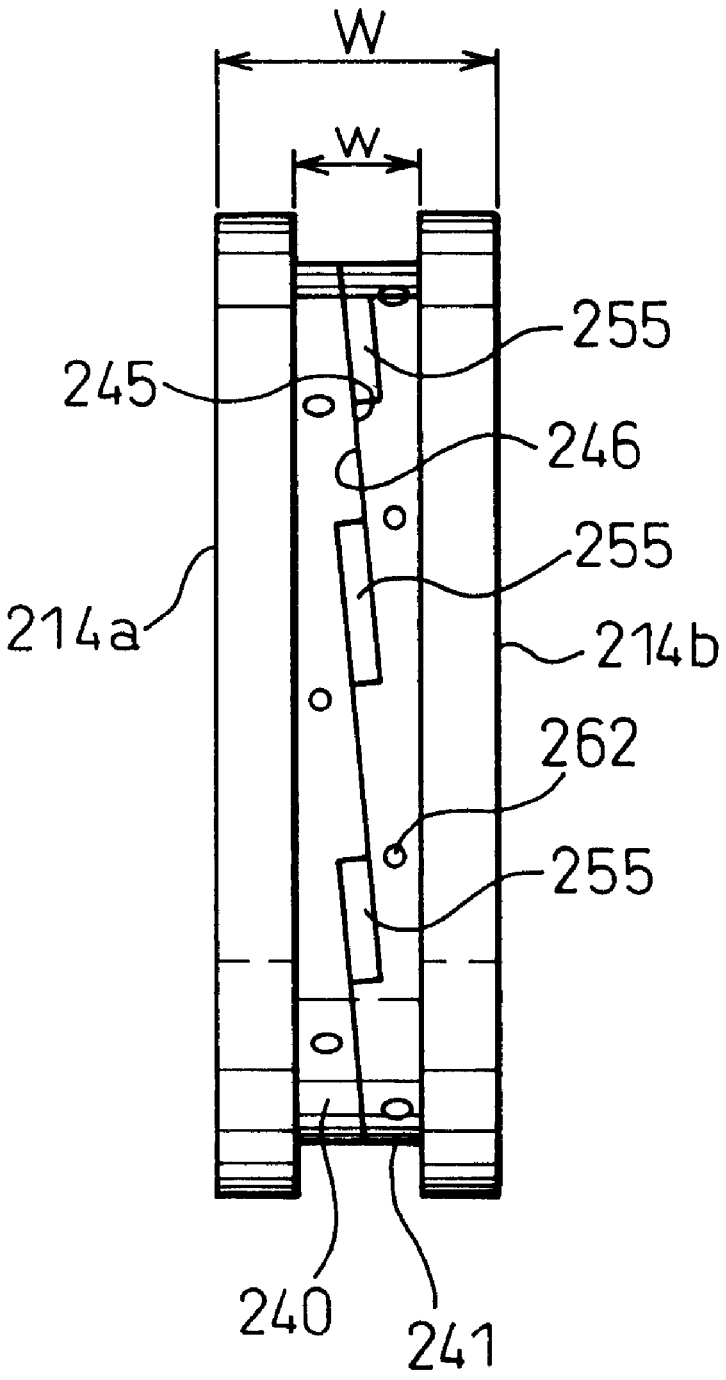
FIG. 22 is an enlarged side view of a drive unit of a web thickness reduction rolling section.

As shown in FIG. 22, each of the stationary wedge ring 240 and the movable wedge ring 241 has a plurality of tapered faces 245, 246, which are sectioned in the circumferential direction, on the wedge side end face. When they are viewed from the side, these sectioned tapered faces 245, 246 have a sawtooth-shape. When the movable wedge ring 241 is rotated relatively with the stationary wedge ring 240 under the condition that the sectioned tapered faces 245, 246 are contacted with each other, the distance W between the stationary wedge ring 240 and the movable wedge ring 241 can be finely adjusted.

As shown in FIG. 21, an outer screw is formed on the outer circumferential face of the upper horizontal roller shaft 222 which forms an outside of the flange width reduction roller sections 218, 219. Pushing nuts 251, 252 are screwed to the outer screw formed on the outer circumferential face of the upper horizontal roller shaft 222. In the upper horizontal roller shaft 222, there are provided spacer rings 253, 254 between the first 214*a* and the second web thickness reduction roller section 214*b*. Due to the above structure, the first 214*a* and the second web thickness reduction roller section 214*b* are pushed against the width adjustment ring 242 by the pushing nuts 251, 252 via the spacer rings 253, 254. Therefore, the first 214*a* and the second web thickness reduction roller section 214*b* and the width adjustment ring 242 can be integrally fixed to each other.

In this way, a distance between the outside 247*a* of the first web thickness reduction roller section 214*a* and the outside 248*a* of the second web thickness reduction roller section 214*b* can be set, that is, roller width W can be set.

In this connection, although it depends upon the pushing forces of the pushing nuts 251, 252 and also it depends upon the inclination angles of the sectioned tapered faces 245, 246 of the stationary wedge ring 240 and the movable wedge ring 241, when the H-beam 13 is rolled by the first 214*a* and the second web thickness reduction roller section 214*b*, there is a possibility that the movable wedge ring 241 is rotated with respect to the stationary wedge ring 240 and roller width W cannot be kept constant.

In order to prevent the occurrence of the above problem, the following countermeasures are taken in the present embodiment. When the movable wedge ring 241 is relatively rotated with respect to the stationary wedge ring 240, a sector-shaped stopper (not shown) is inserted into a sector-shaped space 255 formed between both the wedge rings 240, 241 as shown in FIG. 22, so that the relative rotation of the movable wedge ring 241 with respect to the stationary wedge ring 240 can be completely prevented. Due to the foregoing, roller width W can be positively kept constant after the setting.

As shown in FIGS. 21 and 22, rod engagement holes 261, 262 are respectively formed at predetermined circumferential intervals on the outer circumferential faces of the stationary wedge ring 240 and the movable wedge ring 241. When rod-shaped jigs are inserted into the rod engagement holes 261, 262 and rotated, the movable wedge ring 241 can be easily rotated with respect to the stationary wedge ring 240.

The following are explanations of the method for adjusting roller width W in which the first 214*a* and the second web thickness reduction roller section 214*b* of the present embodiment are used.

(1) First, the pushing nuts 251, 252 are loosened on line, and the first 214*a* and the second web thickness reduction rolling sections 214*b* are moved onto both sides on the upper horizontal roller shaft 222.

(2) When the movable wedge ring 241 is relatively rotated under the condition that the stationary wedge ring 240 is fixed, the sector-shaped space 255 is extended, and the stopper is drawn out.

(3) Roller width W to be adjusted is determined from the size of the H-beam 13 which is going to be rolled, and a stopper (not shown) corresponding to roller width W is selected and attached to the sector-shaped space 255.

(4) The movable wedge ring 241 is relatively rotated again under the condition that the stationary wedge ring 240 is fixed, so that the movable wedge ring 241 is fastened to the stationary wedge ring 240, and distance w of the width adjustment ring 242 is set.

(5) When the first 214*a* and the second web thickness reduction rolling section 214*b* are fastened by the pushing nuts 251, 252 under the condition that the width adjustment ring 242 is interposed between them, roller width W is set. In this connection, usually, the fine adjustment interval of roller width W is ±10 mm.

As described above, only when the width adjustment ring 242 substantially composed of the stationary wedge ring 240 and the movable wedge ring 241 is used, fine adjustment can be easily and positively conducted on roller width W.

In this embodiment, the flange width reduction roller sections 218, 219, 220, 221, which are edger rolling rollers for reducing the upper and the lower edge portion of the H-beam 13, are attached onto both sides of the web thickness reduction rolling sections 214, 215 as shown in FIG. 21.

As shown in FIG. 21 showing this embodiment, on both sides of the H-beam 13, the vertical rollers 275, 276 are arranged which are attached to the vertical roller chocks 277, 278. The flange thickness reduction rollers 216, 217 are pivotally supported by the vertical roller shafts 275, 276. The vertical roller chocks 277, 278 can be freely positioned in the horizontal direction by the vertical roller screw down devices 279, 280. When the flat outer circumferential faces of the flange thickness reduction rollers 216, 217 are pressed against the external sides of the flanges of the H-beam 13, the finish flange thickness of the H-beam 13 can be determined, and further it is possible to conduct universal rough rolling on the H-beam 13.

Next, referring to FIGS. 23 to 25, the multifunction rolling mill of the third embodiment of the present invention will be explained below.

Figure 23:
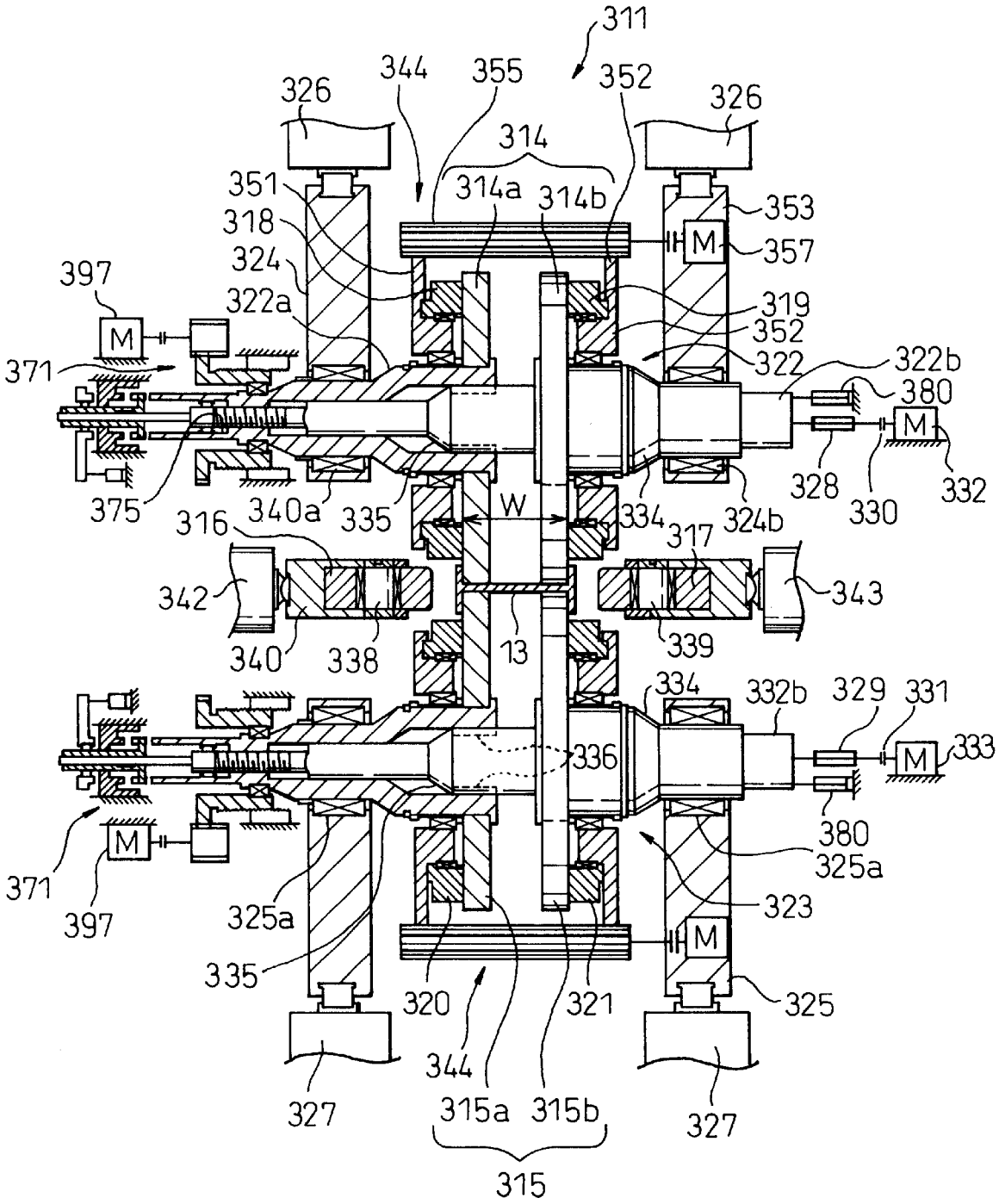
FIG. 23 is a cross-sectional side view of a multifunction rolling mill used for a rolling apparatus, for rolling an H-beam, of the third embodiment of the present invention.

Referring to FIG. 23, the multifunction rolling mill 311 includes: a pair of rollers 314, 315 for reducing the web thickness by which the finish thickness of the web of the H-beam 13 is determined; a pair of rollers 316, 317 for reducing the flange thickness by which the finish thickness of the flange of the H-beam 13 is determined; and rollers 318, 319, 320, 321 for reducing the flange width by which the upper and the lower flange edge portion of the H-beam 13 are reduced. In this structure, a pair of right and left vertical rollers are composed of the flange thickness reduction rollers 316, 317, and a pair of upper and lower horizontal rollers are composed of the web thickness reduction rollers 314, 315 and the flange width reduction rollers 318 to 321. However, as described later, in this embodiment, the web thickness reduction rollers 314, 315 and the flange thickness reduction rollers 316, 317 are used for not only universal finish rolling but also universal rough rolling.

As shown in FIG. 23, a pair of upper and lower horizontal roller shafts 322, 323 are arranged right above and right below the H-beam 13 which is a piece of work to be rolled by the multifunction rolling mill 311. Both end portions of the horizontal roller shafts 322, 323 are pivotally supported by the horizontal roller chocks 324, 325 via the bearings 324*a*, 325*a*. The horizontal roller chocks 324, 325 are attached to the horizontal screw down devices 326, 327 and respectively moved in the vertical direction by the horizontal roller screw down devices independently from each other. One end portions of the horizontal roller shafts 322, 323 are connected with the horizontal roller shaft drive motors 332, 333 via the spline joints 328, 329 and the universal joints 330, 331.

As shown in FIG. 23, the horizontal roller shafts 322, 323 include: hollow roller shafts 322*a*, 323*a* which are arranged coaxially with each other; and solid roller shafts 322*b*, 323*b*, some portions of which can be moved in the axial direction in the hollow roller shafts 322*a*, 323*a* being inserted into the hollow roller shafts 322*a*, 323*a*, however, the entire solid roller shafts 322*b*, 323*b* can not be relatively rotated with respect to the hollow roller shafts 322*a*, 323*a*. Each solid roller shaft 322*b*, 323*b* includes a large diameter section 334 and a small diameter section 335 which is coaxially integrated with the large diameter section 334. The small diameter section 335 is slidably inserted into the hollow roller shaft 322*a*, 323*a*. There is provided a sliding key between the outer circumferential face of the small diameter section 335 and the inner circumferential face of the hollow roller shaft 322*a*, 323*a*. On the outer circumferential face of the end portion of the hollow roller shaft 322*a*, 323*a* and also on the outer circumferential face of the end portion of the large diameter section 334 of the solid roller shaft 322*b*, 323*b*, the first 314*a*, 314*b* and the second web thickness reduction roller sections 315*a*, 315*b* are fixed by means of shrinkage fitting. In this connection, the hollow roller shafts 322*a*, 323*a* and the solid roller shafts 322*b*, 323*b* may be composed being integrated into one body with the first 314*a*, 314*b* and the second web thickness reduction rolling sections 315*a*, 315*b*.

When the solid roller shafts 322*b*, 323*b* are rotated by driving the horizontal roller shaft driving motors 332, 333, the hollow roller shafts 322*a*, 323*a* are integrally rotated. When the above components are rotated as described above, the first 314*a*, 314*b* and the second web thickness reduction rolling sections 315*a*, 35*b* are also integrally rotated. When the flat outer circumferential faces of the first and the second web thickness reduction roller sections 314*a*, 314*b*, 315*a*, 315*b* are contacted with and pressed against the upper and the lower face of the web of the H-beam 13, the finish web thickness of the H-beam 13 can be set and universal rough rolling can be carried out.

The small diameter sections 335 of the solid roller shafts 322*b*, 323*b* are slidably inserted into the hollow roller shafts 322*a*, 323*a*. Therefore, when the roller width adjusting mechanism 371 described later is driven, width of the web thickness reduction roller sections 314, 315, that is, roller width W can be freely adjusted according to the size of the H-beam 13.

On the other hand, as shown in FIG. 23, there are provided vertical roller shafts 338, 339 on both sides of the H-beam 13. Both end portions of the vertical roller shafts 338, 339 are attached to the vertical roller chocks 340, 341 and arbitrarily positioned in the horizontal direction by the drive devices 342, 343.

The flange thickness reduction rollers 316, 317 are pivotally supported by the vertical roller shafts 338, 339. When the flat outer circumferential faces of the flange thickness reduction rollers 316, 317 are pressed against the external sides of the flanges of the H-beam 13, the finish flange thickness of the H-beam 13 can be determined, and further it is possible to conduct universal rough rolling on the H-beam 13.

In this embodiment, the flange width reduction roller sections 318, 319, 320, 321, which are edger rolling rollers for reducing the upper and the lower edge portion of the H-beam 13, are attached onto both sides of the web thickness reduction rolling sections 314, 315 composed of the horizontal rollers at the central portions of the horizontal rollers 322, 323 as shown in FIG. 23.

As shown in FIG. 9, when the end portions of the flanges of the H-beam 13 are reduced, the flange width reduction rollers 318, 319, 320, 321 are located at the reduction positions which proceed to pass line P of the H-beam 13. However, when the finish web thickness of the H-beam 13 is determined by the web thickness reduction rollers 314, 315 and also when the finish flange thickness of the H-beam 13 is determined by the flange thickness reduction rollers 316, 317 and also when universal rough rolling is conducted on the H-beam 13, the flange width reduction rollers 318, 319, 320, 321 are easily and positively retracted to the respective retracting positions by the roller retracting mechanism 344 which is the same as that described before.

Next, referring to FIGS. 24 and 25, the structure of the roller width adjusting mechanism 371 will be explained below, by which the first 314*a*, 314*b* and the second web thickness reduction rolling sections 315*a*, 315*b* are relatively moved in the axial direction so that the width of the web thickness reduction rolling sections 315*a*, 315*b*, that is, roller width W, can be easily and quickly adjusted.

The hollow roller shaft 322*a* is composed of a large diameter cylindrical section 372, an intermediate diameter cylindrical section 373 and a small diameter cylindrical section 374 which are coaxially integrated into one body being arranged from the center to the end.

A stepwise small diameter section 335 is slidably inserted in the axial direction into the large diameter cylindrical section 372 and the intermediate diameter cylindrical section 373. On the other hand, the roller width adjustment screw shaft 375 is arranged in the small diameter cylindrical section 374 of the hollow roller shaft 322*a* coaxially with the small diameter section 335.

The male screw section 376 is formed on the outer circumferential face of the roller width adjustment screw shaft 375 and screwed into the female screw section 377 formed on the inner circumferential face of the small diameter cylindrical section 374. One end (end portion on the central side) 378 of the roller width adjustment screw shaft 375 comes into contact with a spherical mount 379, which is formed on an end face of the small diameter section (engaging section) 335 of the solid roller shaft 322*b*, being pressed by a pushing cylinder used for removing play. The roller width adjustment screw shaft 375 is provided with the small diameter shaft section 381 extending outside. At one end of the small diameter shaft section 381, there are provided an internal clutch claw 383 and an external clutch claw 384 which are arranged via a sliding key 382. At the other end of the small diameter shaft section 381, there is provided a cylindrical clutch 386 with which an upper end of the cylinder attachment plate 385 is connected. With the lower end of the cylinder attachment plate 385, the clutch opening and closing cylinder 387 for operating the cylindrical clutch 386 is connected.

At the external end of the small diameter cylindrical section 374 of the hollow roller shaft 322*a,* there is provided a first engagement claw 388 capable of engaging with the internal clutch claw 383 being linked with the movement of the cylindrical clutch 386 in the axial direction. On the other hand, on the outer circumference of the cylindrical clutch 386, there is coaxially provided an annular stationary block 389. On the inside end face of the stationary block 389, there is provided a second engagement claw 390 which is linked with the movement of the cylindrical clutch 386 in the axial direction. On the outer circumferential face of the small diameter cylindrical section 374 of the hollow roller shaft 322*a,* there is pivotally provided a sleeve 392 which is used for moving the hollow roller shaft. On the outer circumferential face of the sleeve 392 for moving the hollow roller shaft, there is provided a male screw section 393. The female screw section 395, which is provided on the inner circumferential face of the stationary block 394 coaxially arranged on the outer circumferential face of the sleeve 392 for moving the hollow roller shaft, is screwed to this male screw section 393.

At the external end portion of the sleeve 392 for moving the hollow roller shaft, there is integrally provided a gear 396 for moving the hollow roller shaft. The gear 396 for moving the hollow roller shaft is meshed with the pinion 399 for moving the hollow roller shaft connected with the output shaft of the actuator 397 for moving the hollow roller shaft via the joint 398.

For example, when roller width W is extended from a state shown in FIG. 25, in which roller width W is narrow, to a state shown in FIG. 24 in which roller width W is wide, the operation is conducted as follows. The clutch opening and closing cylinder 387 is driven, so that the external clutch claw 384 of the cylindrical clutch 386 is engaged with the second engagement claw 390 of the stationary block 389, and the roller width adjustment screw shaft 375 is fixed. When the horizontal roller shaft drive motor 332 is driven under the above condition, the hollow roller shaft 322*a* is rotated which is connected with the solid roller shafts 322*b* via the sliding key 336. In this case, since the female screw section 377 of the hollow roller shaft 322*a* is screwed to the male screw section 376 of the roller width adjustment screw shaft 375 which is in a stationary condition in the rotational direction, the roller width adjustment screw shaft 375 is moved onto the horizontal roller shaft rotating motor 322 side.

As a result, the solid roller shaft 322*b,* the small diameter section 335 of which comes into contact with the center side end portion 378 of the roller width adjustment screw shaft 375 being pressed, is integrally moved onto the horizontal roller shaft rotating motor 332 side. Therefore, the second web thickness reduction rolling section 314*b* is moved being separated from the first web thickness reduction rolling section 314*a.* In this way, roller width W between the first 314*a* and the second web thickness reduction rolling section 314*b* can be adjusted.

However, in the above case, only the second web thickness reduction rolling section 314*b* is moved. Therefore, the rolling center is not located on pass line P.

Therefore, in the next step, the actuator 397 for moving the hollow roller shaft is driven, so that the sleeve 392 for moving the hollow roller shaft is rotated via the pinion 399 for moving the hollow roller shaft. In this case, since the male screw section 393 of the sleeve 392 for moving the hollow roller shaft is screwed to the female screw section 395 of the stationary block 394, the sleeve 394 for moving the hollow roller shaft is moved onto the clutch opening and closing cylinder 387 side, and the hollow roller shaft 322*a* is also moved being linked with this movement. The roller width adjustment screw shaft 375 is also moved in the same direction being linked with this movement of the hollow roller shaft 322*a.* The solid roller shaft 322*b,* which is pressed against the roller width adjustment screw shaft 375 by the pushing cylinder 380 for removing play, is moved by the same distance being linked with this movement. Accordingly, it is possible to accurately move the roller center onto pass line P without changing roller width W which has already been adjusted.

Figure 24:
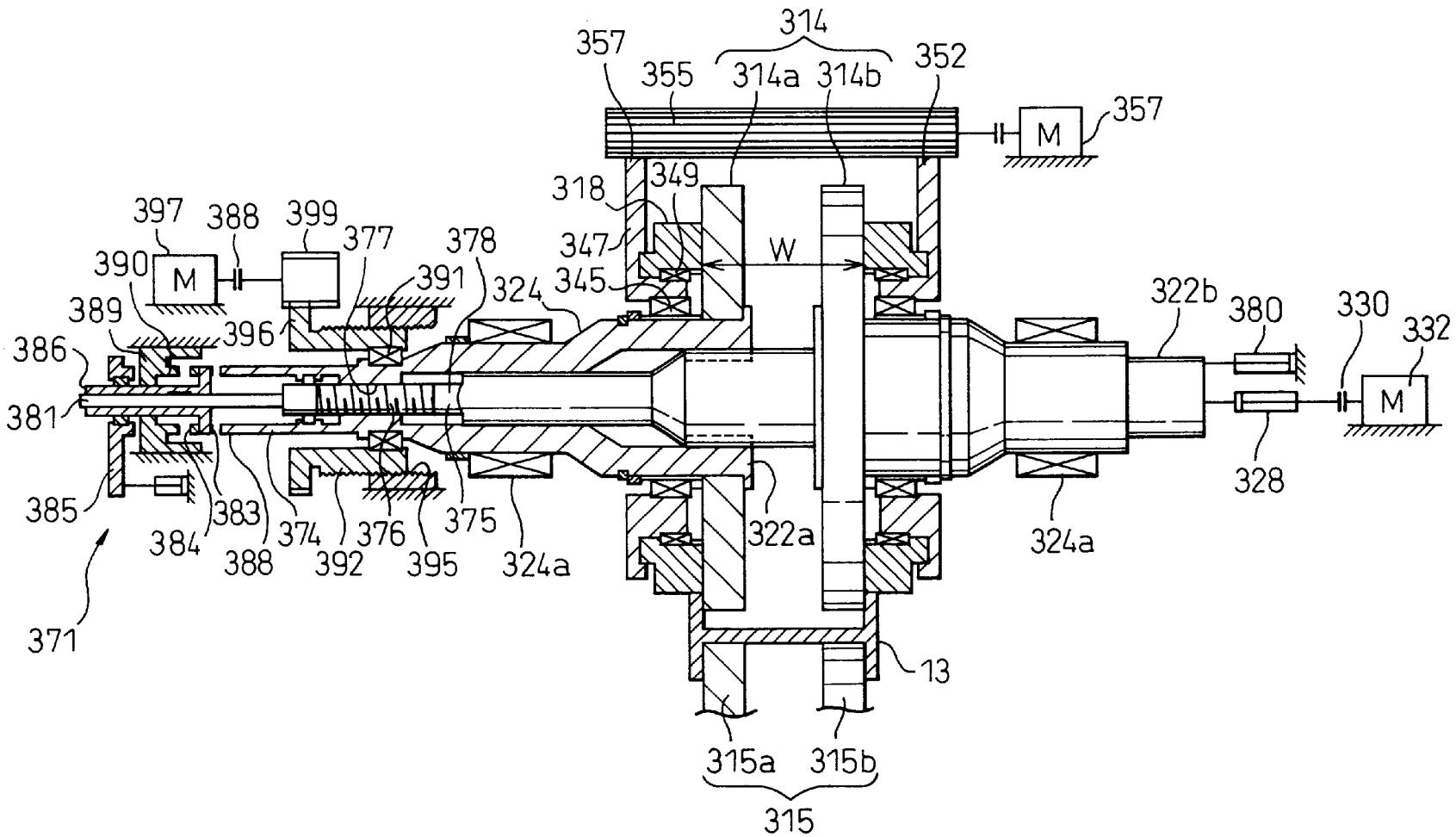
FIG. 24 is a partially enlarged cross-sectional side view of the multifunction rolling mill shown in FIG. 23 in the case where a distance between the rollers of the web thickness reduction rolling section is large and the roller retracting mechanism is set at the reduction position.

After that, the clutch opening and closing cylinder 387 is driven, so that the outer clutch claw 384 of the cylindrical clutch 386 is released from the second engagement claw 390 of the stationary block 389, and the inner clutch claw 383 of the cylindrical clutch 386 is engaged with the first engagement claw 388 of the outer end of the small diameter cylindrical section 374 of the hollow roller shaft 322*a.* Due to the foregoing, the horizontal roller shaft rotating motor 332 is driven, and the predetermined rolling can be performed under the condition that roller width W is extended as shown in FIG. 24.

Figure 25:
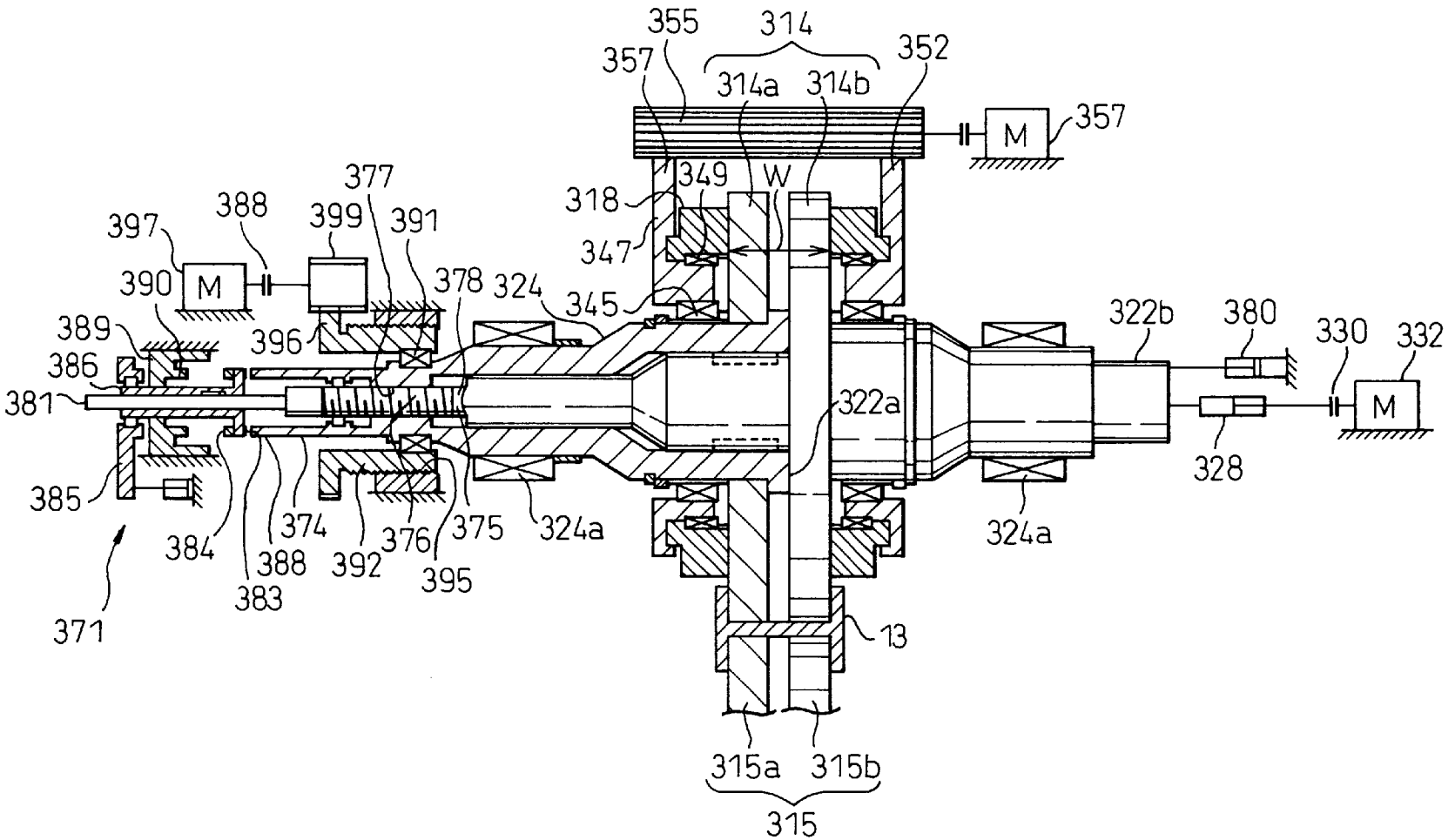
FIG. 25 is a partially enlarged cross-sectional side view of the multifunction rolling mill shown in FIG. 23 in the case where a distance between the rollers of the web thickness reduction rolling section is small and the roller retracting mechanism is set at the reduction position.

When the roller width adjustment mechanism 371 is operated again, roller width W can be easily, quickly and positively adjusted from a state shown in FIG. 24, in which roller width W is wide, to a state shown in FIG. 25 in which roller width W is narrow.

Figure 26:
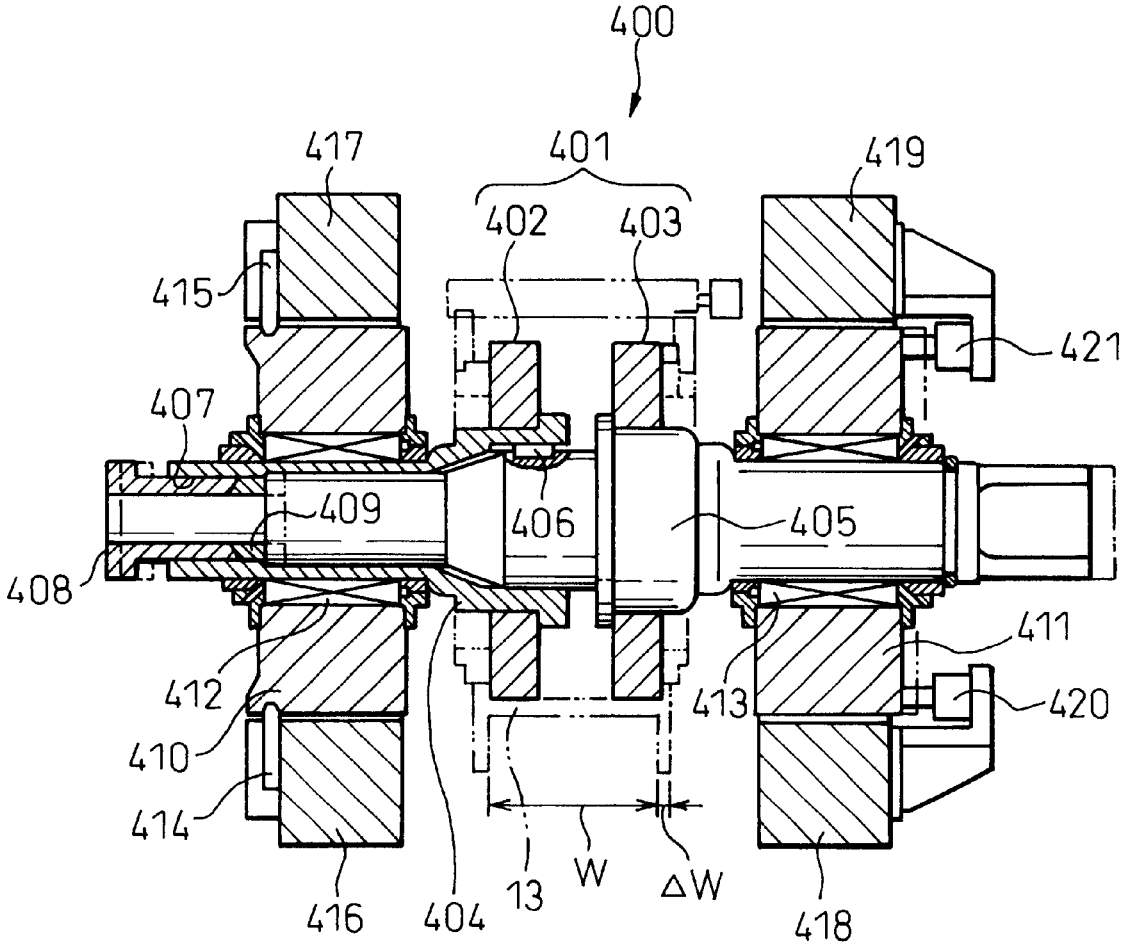
FIG. 26 is a partially cross-sectional side view of a multifunction rolling mill used for a rolling apparatus, for rolling an H-beam, of the fourth embodiment of the present invention.

As shown in FIG. 26, the multifunction rolling mill 400 of this embodiment is characterized in that: when the first 402 and the second web thickness reduction rolling section 403, which form the upper web thickness reduction rolling section 401, are relatively moved in the axial direction, roller width W, which is the width between the first 402 and the second web thickness reduction rolling section 403, can be easily and positively adjusted. In this connection, as shown in the drawing, the multifunction rolling mill 400 of this embodiment includes the same roller retracting mechanism 358*a* as that described before. Although not shown in the drawing, the lower web thickness reduction rolling section also has the same structure as that of the upper web thickness reduction rolling section 401.

The upper web thickness reduction rolling section 401 is composed of the first 402 and the second web thickness reduction rolling section 403 which are formed when the upper web thickness reduction rolling section 401 is divided into two in the width direction. The first web thickness reduction rolling section 402 is arranged on the outer circumference of the hollow roller shaft 404. The hollow roller shaft 404 is slidably engaged with the outside of the solid roller shaft 405 in the axial direction, and the hollow roller shaft 404 and the solid roller shaft 405 cannot be rotated relatively to each other by the action of the sliding key 406. That is, the solid roller shaft 405 is inserted into the hollow portion of the hollow roller shaft 404 in such a manner that the solid roller shaft 405 can be relatively moved with respect to the hollow roller shaft 404 only in the axial direction because the movement of the solid roller shaft 405 is restricted by the sliding key 406. There is provided a female screw section 407 on the inner circumference of the hollow roller shaft 404 close to the shaft end, and the roller width adjustment screw shaft 408 is screwed to this female screw section 407.

Reference numeral 409 is a spherical mount which functions as a self-aligning type spacer for making the load distribution between the roller width adjustment screw shaft 408 and the hollow roller shaft 404 uniform. Reference numerals 410, 411 are bearing housings, which pivotally support the upper web thickness reduction rolling section 401 via the bearings 412, 413. The bearing housing 410 is held by the keeper plates 414, 415 and the roller housings 416, 417 in such a manner the bearing housing 410 can not be moved in the axial direction of the roller. The bearing housing 411 is supported in the axial direction of the roller by the clearance adjustment devices 420, 412 attached to the roller housings 418, 419. Due to the above structure, the distance between the first 402 and the second web thickness reduction rolling section 403 can be set at an arbitrary value, that is, the width of the upper web thickness reduction rolling section 401 can be set at an arbitrary value.

The operation will be explained below in the case where the upper web thickness reduction rolling section 401 is increased by ΔW.

First, the clearance adjustment devices 420, 421 are operated so that the bearing housing 411 can be separated from the bearing housing 410 by at least ΔW in the axial direction. Next, the roller width adjustment screw shaft 408 is rotated so that reduction can be given to the solid roller shaft 405 by ΔW. Next, the clearance adjustment devices 420, 421 are operated so that the bearing housing 411 can be moved to the bearing housing 410. In this way, clearances in the axial direction of the roller width adjustment screw shaft 408, spherical mount 109 and solid roller shaft 405 can exceed the allowed values. It is preferable that the clearance adjustment devices 420, 421 are composed of hydraulic cylinders. When the hydraulic pressure is set at a constant value, the clearances in the axial direction of the roller width adjustment screw shaft 408, spherical mount 109 and solid roller shaft 405 can be made zero. Further, it is possible to provide a pre-load.

When operation is conducted as described above, by the roller width adjustment screw shaft 408 and the clearance adjustment devices 420, 421, the hollow roller shaft 404 can be set so that the hollow roller shaft 404 is separate from the solid roller shaft 405 by ΔW in the axial direction, that is, so that the first web thickness reduction rolling section 402 can be separate from the second web thickness reduction rolling section 103 by ΔW in the axial direction. In this way, the roller width can be extended by ΔW in the upper web thickness reduction rolling section 401.

The fifth embodiment of the present invention will be explained below.

Figure 27:
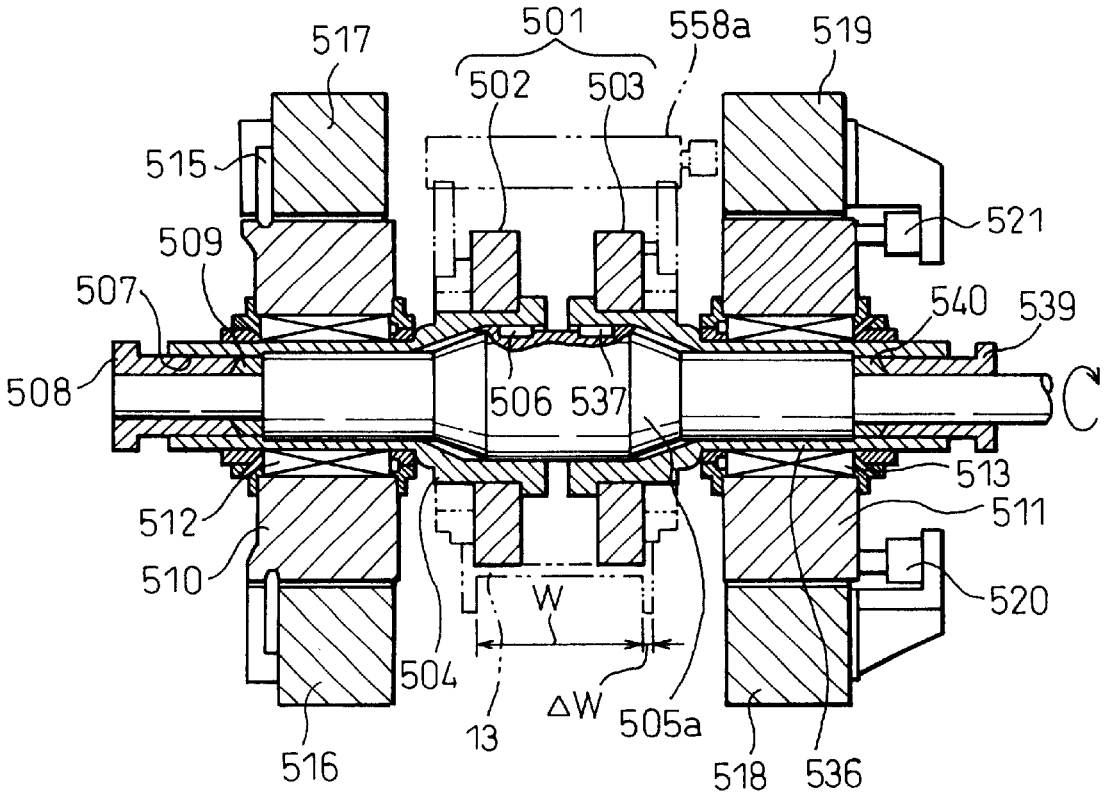
FIG. 27 is a partially cross-sectional side view of a multifunction rolling mill used for a rolling apparatus, for rolling an H-beam, of the fifth embodiment of the present invention.

FIG. 27 is a view showing a variation of the apparatus shown in FIG. 26. In this variation, the second web thickness reduction rolling section 403 of the fourth embodiment has the same structure as that of the first web thickness reduction rolling section 402.

In this embodiment, the second web thickness reduction rolling section 503 is connected with the hollow roller shaft 536, the inside of which is engaged with the solid roller shaft 505*a* so that it can be slid in the axial direction. Since the sliding key 537 is provided between the hollow roller shaft 536 and the solid roller shaft 505*a*, the solid roller shaft 505*a* can not be relatively rotated with respect to the hollow roller shaft 536. The female screw section 538 is formed on the inner circumference of the hollow roller shaft 536, and the male screw section of the roller width adjustment screw shaft 539 is screwed to the female screw section 538, and one end of the hollow roller shaft 536 comes into contact with an end face of the solid roller shaft 505*a* with pressure. Reference numeral 540 is a spherical mount, which makes a load distribution between the roller width adjustment screw shaft 539 and the solid roller shaft 505*a* uniform.

Due to the above structure, in the same manner as that of the fourth embodiment shown in FIG. 26, the roller width adjustment can be carried out when the roller width adjustment screw shaft 508 or 539 is adjusted for reduction.

Next, referring to FIG. 28, the sixth embodiment of the present invention will be explained below. The multifunction rolling mill 611 includes: a pair of rollers 622, 623 for reducing the web thickness by which the finish thickness of the web of the H-beam 13 is determined; a pair of rollers 630, 631 for reducing the flange thickness by which the finish thickness of the flange of the H-beam 13 is determined; and a pair of upper and lower rollers 632, 633, 634, 635 for reducing the flange width by which the flange edge portions of the H-beam 13 are reduced. In this case, a pair of right and left vertical rollers are composed of the flange thickness reduction rollers 630, 631, and a pair of upper and lower horizontal rollers are composed of the web thickness reduction rollers 622, 623 and the flange width reduction rollers 662 to 665. However, as described later, in this embodiment, the web thickness reduction rollers 622, 623 and the flange thickness reduction rollers 630, 631 are used for not only universal finish rolling but also for universal rough rolling.

Figure 28:
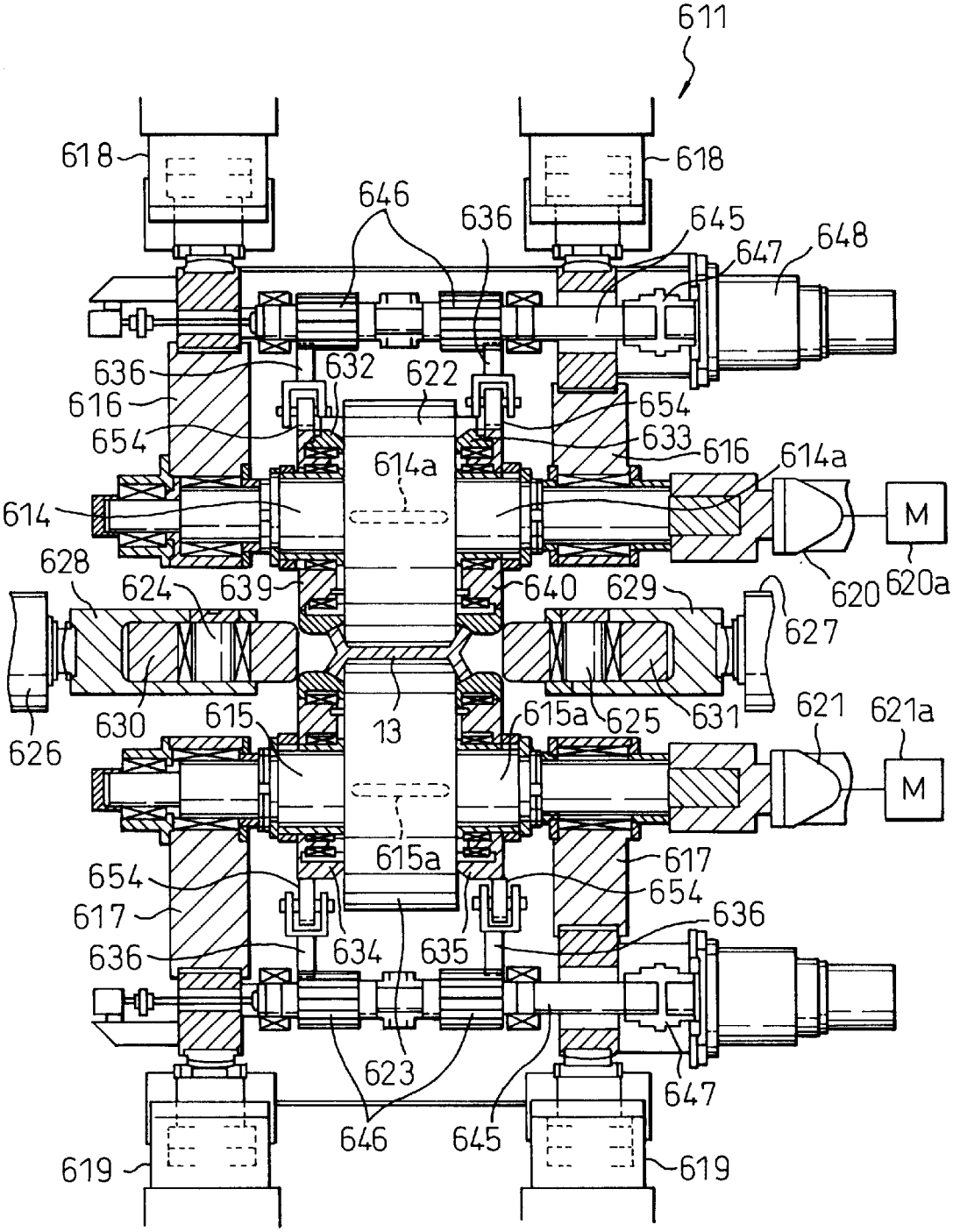
FIG. 28 is a cross-sectional side view of a multifunction rolling mill used for a rolling apparatus, for rolling an H-beam, of the sixth embodiment of the present invention.

As shown in FIG. 28, the horizontal roller shafts 614, 615 are arranged right above and right below the H-beam 13 which is a piece of work to be rolled by the multifunction rolling mill 611. Both end portions of the horizontal roller shafts 614, 615 are pivotally supported by the upper and lower horizontal roller chocks 616, 617. The horizontal roller chocks 616, 617 are respectively attached to the horizontal screw down devices 618, 619, so that they can be respectively moved in the vertical direction independently from each other. One end portions the horizontal roller shafts 614, 615 are connected with the first rotary drive devices 620*a*, 621*a* composed of a rotary motor via the universal joints 620, 621.

AS shown in FIG. 28, the web thickness reduction rolling sections 622, 623 are engaged with and fixed to the centers of the horizontal roller shafts 614, 615 by the stationary keys 614*a*, 615*a*. When flat outer circumferential faces of the web thickness reduction rollers 622, 623 are pressed against an upper and a lower face of the web of the H-beam 13, it is possible to set the finish web thickness of the H-beam 13 and conduct universal rolling. In this connection, it is preferable that the web thickness reduction rollers 622, 623 are composed integrally with the horizontal roller shafts 614, 615.

On the other hand, as shown in FIG. 28, on both sides of the H-beam 13, the vertical roller shafts 624, 625 are arranged which are attached to the vertical roller chocks 628, 629. The flange thickness reduction rollers 630, 631 are pivotally supported by the vertical roller shafts 624, 625. The vertical roller chocks 628, 629 can be freely positioned in the horizontal direction by the vertical roller screw down devices 626, 627. When the flat outer circumferential faces of the flange thickness reduction rollers 630, 631 are pressed against the external sides of the flanges of the H-beam 13, the finish flange thickness of the H-beam 13 can be determined, and further it is possible to conduct universal rough rolling on the H-beam 13.

In this embodiment, as shown in FIG. 28, at the respective centers of the horizontal roller shafts 614, 615, on both sides of the web thickness reduction rollers 622, 623 which compose the horizontal rollers, there are provided a pair of flange width reduction rollers 632, 633, 634, 635 which are edger rolling rollers for reducing the side edge portions of the flanges of the H-beam 13.

As shown in FIG. 2, when the end portions of the flanges of the H-beam 13 are reduced, the flange width reduction rollers 632, 633, 634, 635 are located at the reduction positions which proceed to pass line P of the H-beam 13.

However, when the finish web thickness and the finish flange thickness of the H-beam 13 are set by the web thickness reduction rollers 622, 623 and the flange thickness reduction rollers 630, 631 and also when universal rough rolling is conducted, as shown in Fig. 13, the flange width reduction rollers 632, 633, 634, 635 are easily and positively retracted to the retracting positions by the same retracting mechanism 636 (only the sector gear is shown in FIG. 28) as that of the embodiment described before. Therefore, the flange width reduction rollers 332 to 335 and the flange thickness reduction rollers 630, 631 do not interfere with each other, that is, no interference is caused in the rolling operation by the flange width reduction rollers 332 to 335 and the flange thickness reduction rollers 630, 631.

Figure 29:
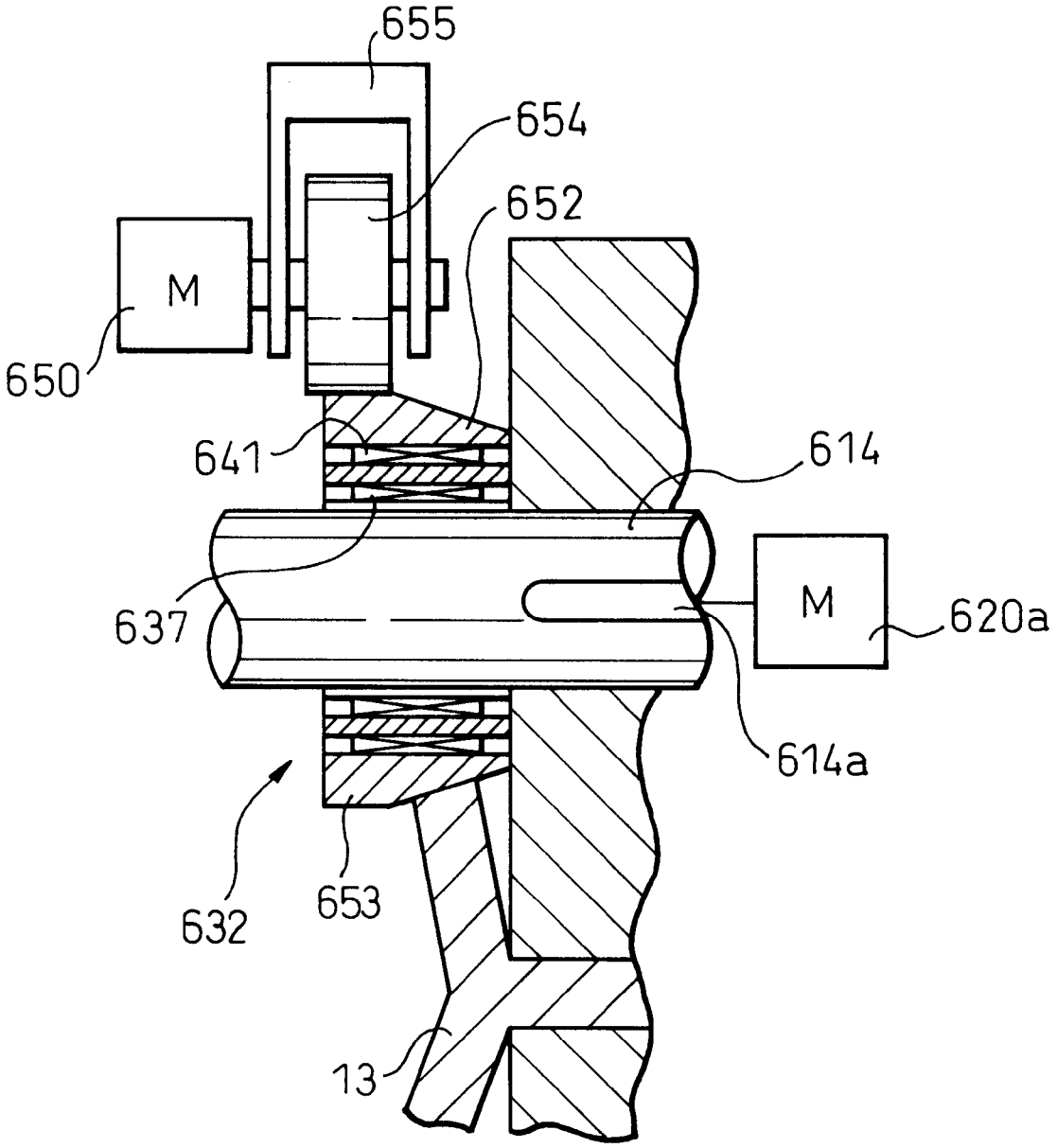
FIG. 29 is a partially enlarged cross-sectional view in which a portion of the multifunction rolling mill shown in FIG. 28 is enlarged.

As shown in FIGS. 28 and 29, in this embodiment, the flange width reduction rollers 632, 633, 634, 635 (only the flange width reduction roller 632 is shown in FIG. 28) are also rotated by the second rotary drive 650 composed of a rotary motor. The flange width reduction roller 632, which is pivotally attached to one side of the upper horizontal roller shaft 614 via the inside bearing 637 and the outside bearing 641, is composed of a tapered cylindrical section 652 and a straight cylindrical section 653, and the backup roller 654 is pressed against the straight cylindrical section 653, and the backup roller 654 is connected with the second rotary drive device 650.

As shown in FIGS. 28 and 29, the backup roller 654 is pivotally attached to an end of the oscillating arm 655, and a base section of the oscillating arm 655 is pivotally connected with the housing of the multifunction rolling mill 611 by an axle (not shown in the drawing) so that it can be freely rotated round the horizontal shaft. A pushing force giving cylinder (not shown in the drawing) for pushing the backup roller 654 toward the flange width reduction roller 632 is connected with the middle portion of the oscillating arm 655. Accordingly, when the backup roller 654 is rotated by driving the second rotary drive device 650 while a pushing force is being given to the flange width reduction roller 632 via the backup roller 654 by driving the pushing force giving cylinder, the flange width reduction roller 632 can be positively rotated. When this flange width reduction roller 632 is rotated, the flanges of the H-beam 13 are also given a predetermined pushing force and the H-beam 13 is drawn out.

In this connection, although not shown in the drawing, when the first gear is provided in the straight cylindrical section 653 of the flange width reduction roller 632 and also the second gear meshed with the first gear is provided in the backup roller 654, no slippage is caused between the flange thickness reduction roller 632 and the backup roller 654. Therefore, a rotational drive force of the backup roller 654 can be positively transmitted to the flange width reduction roller 632.

In the sixth embodiment of the present invention, when not only the web thickness reduction roller but also the flange thickness reduction roller is independently driven by a rotary drive device, the web of the H-beam is given a predetermined pushing force, and at the same time, the flanges of the H-beam are given a predetermined pushing force, so that the H-beam can be pushed out. Due to the foregoing, the reduction force of the web thickness reduction roller can be decreased. Therefore, the occurrence of web waves, which are caused when an H-beam, the web thickness of which is much thinner than the flange thickness, is rolled, can be prevented. Due to the above structure, the following advantages can be provided. When an H-beam is transferred from the adjacent universal rough rolling mill to the multifunction rolling mill, the H-beam is kicked out from the universal rough rolling mill. Even after that, a sufficiently high intensity of transfer force can be given to the H-beam. Therefore, the H-beam can be smoothly rolled.

The seventh embodiment of the present invention will be explained below.

Figure 30:
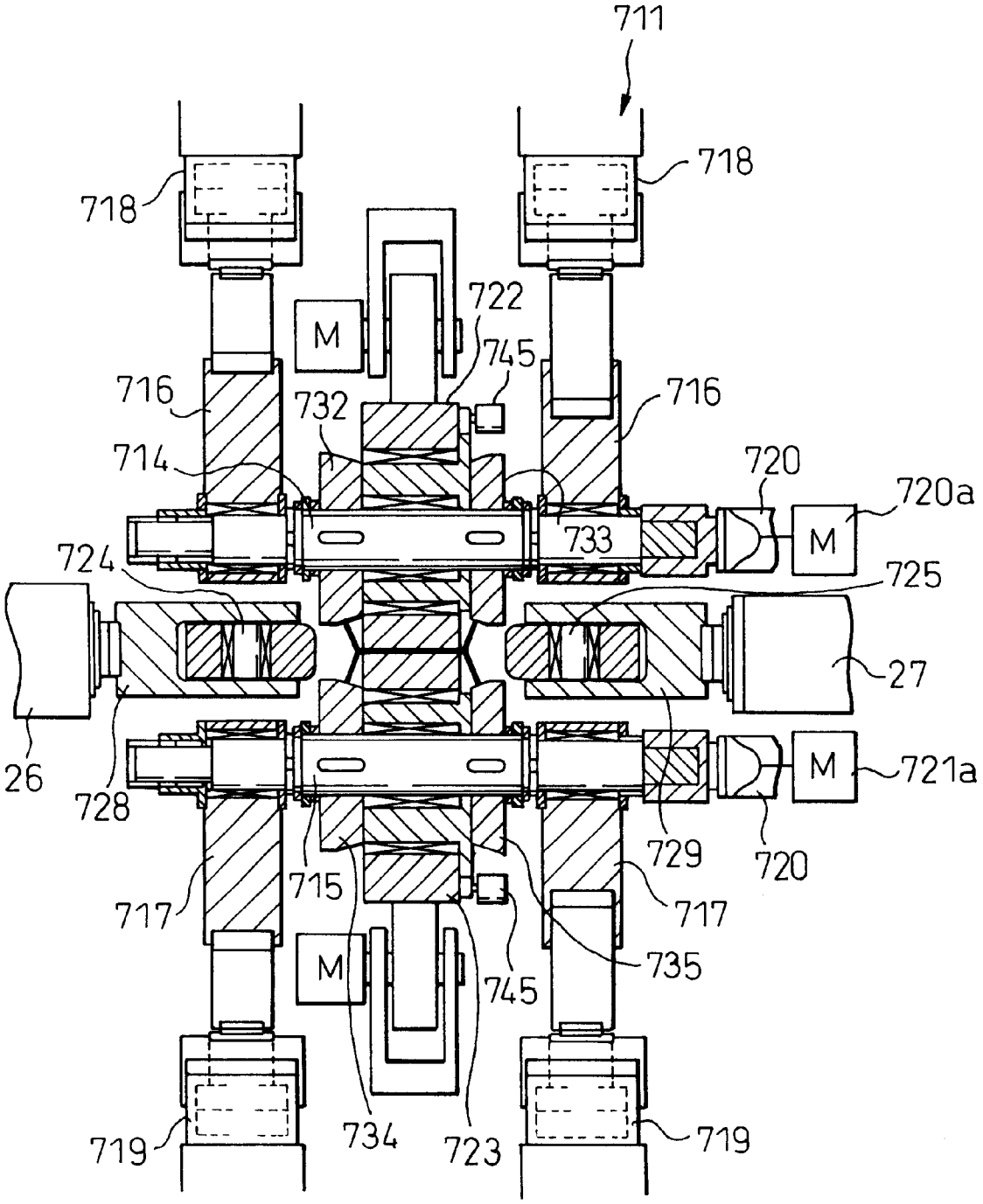
FIG. 30 is a cross-sectional side view of a multifunction rolling mill used for a rolling apparatus, for rolling an H-beam, of the seventh embodiment of the present invention.

Referring to FIG. 30, right above and right below the H-beam 13 which is a piece of work to be rolled by the multifunction rolling mill 711 of the seventh embodiment of the present invention, there are provided a pair of horizontal roller shafts 714, 715 which are examples of the horizontal rollers. Both end sections of the horizontal roller shafts 714, 715 are pivotally supported by the horizontal roller chocks 716, 717. The horizontal roller chocks 716, 717 are respectively connected with the upper 718 and the lower horizontal screw down device 719. Therefore, they can be independently moved in the vertical direction. One end portions of the horizontal roller shafts 714, 715 are connected with the first rotary drive devices 720*a*, 721*a* composed of rotary motors via the universal joints 720, 721.

As shown in FIG. 30, the web thickness reduction rollers 722, 723 are pivotally attached to the centers of the horizontal roller shafts 714, 715. When flat outer circumferential faces of the web thickness reduction rollers 722, 723 are pressed against an upper and a lower face of the web of the H-beam 13, it is possible to set the finish web thickness of the H-beam 13 and conduct universal rough rolling.

On the other hand, as shown in FIG. 30, on both sides of the H-beam 13, the vertical rollers 724, 725 are arranged which are attached to the vertical roller chocks 728, 729. The flange thickness reduction rollers 730, 731 are pivotally supported by the vertical roller shafts 724, 725. The vertical roller chocks 728, 729 can be freely positioned in the horizontal direction by the vertical roller screw down devices 726, 727. When the flat outer circumferential faces of the flange thickness reduction rollers 730, 731 are pressed against the external sides of the flanges of the H-beam 13, the finish flange thickness of the H-beam 13 can be determined, and further it is possible to conduct universal rough rolling on the H-beam 13.

In this embodiment, as shown in FIG. 30, at the respective centers of the horizontal roller shafts 714, 715, on both sides of the web thickness reduction rollers 722, 723 which compose the horizontal rollers, there are provided a pair of flange width reduction rollers 732, 733, 734, 735 which are edger rolling rollers for reducing the side edge portions of the flanges of the H-beam 13.

When the side end portions of the flanges of the H-beam 13 are reduced, the flange width reduction rollers 732, 733, 734, 735 are located at the reduction positions which proceed to pass line P of the H-beam 13. However, when the finish web thickness and the finish flange thickness of the H-beam 13 are set by the web thickness reduction rollers 722, 723 and the flange thickness reduction rollers 730, 731 and also when universal rough rolling is conducted, the web thickness reduction rollers 722, 723 and the flange width reduction rollers 732, 733, 734, 735 are easily and positively retracted to the predetermined retracting positions when the roller retracting mechanism 736 is operated and the horizontal roller shafts 714, 715 are retracted.

That is, as shown in FIGS. 30 and 31, the flange width reduction rollers 732, 733, 734, 735 are fixed to the horizontal roller shafts 714, 715, and the web thickness reduction rollers 722, 723 are connected with the horizontal roller shafts 714, 715, and further the flange width reduction rollers 732, 733, 734, 735 are rotated by the first rotation drive devices 720*a,* 721*a* all together. Furthermore, the horizontal roller shafts 714, 715 are freely moved in the vertical direction by the upper horizontal screw down device 718 and the lower horizontal screw down device 719. One end of the upper horizontal roller shaft 714 is connected with the first rotary drive device 720*a,* and the web thickness reduction roller 722 is pivotally attached to the central portion of the upper horizontal roller shaft 714 via the inside bearing 740, eccentric ring 741 and outside bearing 742. The eccentric ring 741 is connected with the gear 743 provided on the side to be driven. The gear 743 provided on the side to be driven is meshed with the gear 744 provided on the drive side. The gear 744 provided on the drive side is connected with the eccentric ring drive actuator 745. Due to the above structure, when the eccentric ring drive actuator 745 is driven, the web thickness reduction roller 722 can be easily positioned. This can be said in the case of the web thickness reduction roller 723.

In this embodiment, the multifunction rolling mill 711 is provided with a device for driving the web thickness reduction roller 722. That is, the backup roller 746 is pressed against the outer circumferential face of the web thickness reduction roller 722 and the backup roller 746 is connected with the second rotary drive device 747. The backup roller 746 is pivotally attached to an end of the oscillating arm 748 and a base end portion of the oscillating arm 748 is connected with the housing of the multifunction rolling mill 711 in such a manner that it can be freely oscillated round the horizontal shaft. A forward end portion of a rod (not shown) of a pushing force giving cylinder (not shown) for pushing the backup roller 746 against the web thickness reduction roller 722 is connected with a middle portion of the oscillating arm 748. In this connection, the web thickness reduction roller 723 is also rotated by the device having the same structure.

Figure 32:
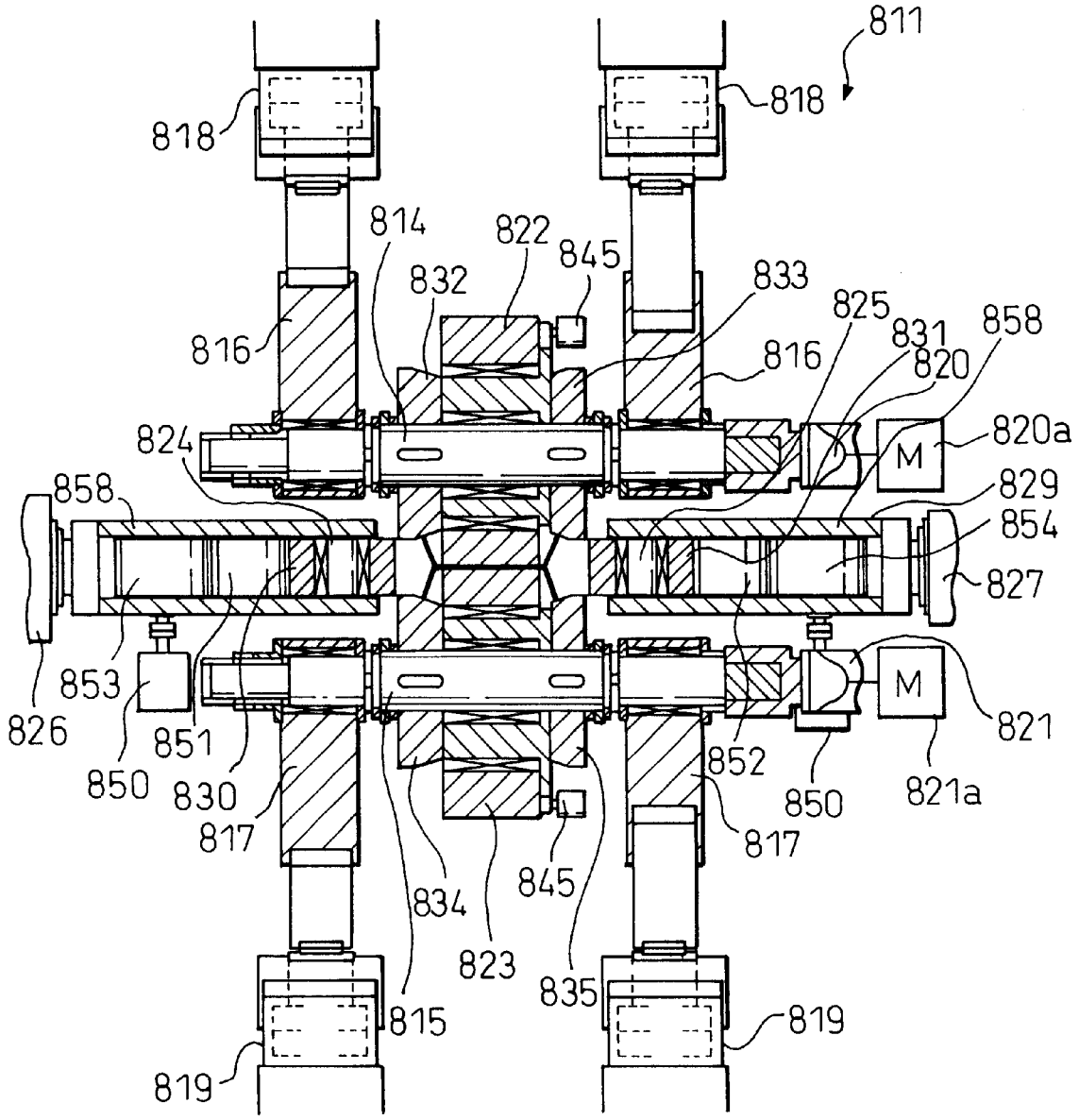
FIG. 32 is a cross-sectional side view of a multifunction rolling mill used for a rolling apparatus, for rolling an H-beam, of the eighth embodiment of the present invention.

Referring to FIG. 32, the multifunction rolling mill 811 of the rolling apparatus for rolling an H-beam of the eighth embodiment of the present invention will be explained below.

The multifunction rolling mill 811 includes: a pair of rollers 822, 823 for reducing the web thickness by which the finish thickness of the web of the H-beam 13 is determined; a pair of rollers 830, 831 for reducing the flange thickness by which the finish thickness of the flange of the H-beam 13 is determined; and rollers 132 to 135 for reducing the flange width by which the upper and the lower flange edge portion of the H-beam 13 are reduced. In this structure, a pair of right and left vertical rollers are composed of the flange thickness reduction rollers 830, 831, and a pair of upper and lower horizontal rollers are composed of a pair of upper and lower flange width reduction rollers 832, 833, 834, 835 and the web thickness reduction rollers 822, 823. However, as described later, in this embodiment, the web thickness reduction rollers 822, 823 and the flange thickness reduction rollers 830, 831 are used for not only universal finish rolling but also for universal rough rolling.

As shown in FIG. 32, a pair of horizontal roller shafts 814, 815 are arranged right above and right below the H-beam 13 which is a piece of work to be rolled by the multifunction rolling mill 811. Both end portions of the horizontal roller shafts 814, 815 are pivotally supported by the horizontal roller chocks 816, 817. The horizontal roller chocks 816, 817 are attached to the upper horizontal screw down device 818 and the lower horizontal screw down device 819 and respectively moved in the vertical direction by the horizontal roller screw down devices independently from each other. One end portions of the horizontal roller shafts 814, 815 are connected with the first rotary drive devices 820*a,* 821*a* composed of rotary motors, via the universal joints 820, 821.

As shown in FIG. 32, the web thickness reduction rollers 822, 823 are pivotally attached to the centers of the roller shafts 814, 815. When the flat outer circumferential faces of the web thickness reduction rollers 822, 823 are contacted with and pressed against the upper and the lower face of the web of the H-beam 13, the finish web thickness of the H-beam 13 can be set and universal rough rolling can be carried out.

On the other hand, as shown in FIG. 32, on both side portions of the H-beam 13, there are provided vertical roller shafts 824, 825 attached to the vertical roller chocks 828, 829, and the flange thickness reduction rollers 830, 831 are pivotally supported by the vertical roller shafts 824, 825. The vertical roller chocks 828, 829 can be freely positioned by the vertical roller screw down devices 826, 827 in the horizontal direction. When the flat outer circumferential faces of the flange thickness reduction rollers 830, 831 are pressed against the external sides of the flanges of the H-beam 13, the finish flange thickness of the H-beam 13 can be determined, and further it is possible to conduct universal rough rolling on the H-beam 13.

In this embodiment, the flange width reduction roller sections 832, 833, 834, 835, which are edger rolling rollers for reducing the edge portion of the H-beam 13, are attached onto both sides of the web thickness reduction rolling sections 822, 823 composed of the horizontal rollers at the central portions of the horizontal rollers 814, 815, as shown in FIG. 32. When the end portions of the flanges of the H-beam 13 are reduced, the flange width reduction rollers 832, 833, 834, 835 are located at the reduction positions which proceed to pass line P1 of the H-beam 13.

However, when the finish web thickness of the H-beam 13 is determined by the web thickness reduction rollers 822, 823 and also when the finish flange thickness of the H-beam 13 is determined by the flange thickness reduction rollers 830, 831 and also when universal rough rolling is conducted on the H-beam 13, the web thickness reduction rollers 822, 823 and the flange width reduction rollers 832, 833, 834, 835 are driven by the roller movement mechanisms (not shown), and when the roller shafts 814, 815 are retracted, they can be easily and positively retracted to the predetermined retracting positions. Therefore, the flange width reduction rollers 832, 833, 834, 835 and the flange thickness reduction rollers 830, 831 do not interfere with each other, that is, no interference is caused in the rolling operation by the flange width reduction rollers 832, 833, 834, 835 and the flange thickness reduction rollers 830, 831.

As shown in FIG. 32, the flange width reduction rollers 832, 833, 834, 835 are attached to the roller shafts 814, 815, and the web thickness reduction rollers 822, 823 are pivotally attached to the roller shafts 814, 815. Further, the flange width reduction rollers 832, 833, 834, 835 are driven all together by the first rotary drive devices 820*a,* 821*a,* and furthermore the roller shafts 814, 815 are freely moved in the vertical direction by the upper 818 and the lower horizontal screw down device 819.

In this embodiment, the flange thickness reduction rollers 830, 831 are also driven by the second rotary drive device 850 composed of rotary motors. As shown in FIG. 32, at the rear and outside of the flange thickness reduction rollers 830, 831, there are provided a pair of backup rollers 851, 852 for pushing the flange thickness reduction rollers 830, 831. Further outside of the backup rollers 851, 852, there are provided drive rollers 853, 854. The drive side rollers 853, 854 are connected with the second rotary drive device 850 composed of rotary motors, via rotary shafts (not shown). The flange thickness reduction rollers 830, 831, the backup rollers 851, 852 and the drive side rollers 853, 854 are pivotally attached to the roller retracting housing 858. The roller retracting housing 858 is connected with the vertical roller screw down devices 826, 827.

Accordingly, when the vertical roller screw down devices 826, 827 are driven, while the pushing forces are being given to the flange thickness reduction rollers 830, 831 via the roller retracting housing 858, the second rotary drive device 850 is rotated. Due to the foregoing, the flange thickness reduction rollers 830, 831 can be positively rotated via the drive side rollers 853 and the pair of backup rollers 851, 852. When these flange thickness reduction rollers 830, 831 are rotated, the H-beam 13 can be extruded by a predetermined pushing force.

According to the above structure, in this embodiment, when only two sets of rolling mills including the multifunction rolling mill 811 and the universal rough rolling mill 812 are used, it is possible to carry out universal rough rolling, edging rolling and universal finish rolling. In other words, according to this embodiment in which the multifunction rolling mill 811 is used, the number of the rolling mills can be decreased, that is, according to the prior art, it is necessary to provide at least three rolling mills after the breakdown rolling mill 810, however, according to this embodiment, the number of the rolling mills can be decreased to two, and at the same time, the length of the building can be shortened and also the length of the foundation can be shortened. As a result, the equipment cost of the rolling apparatus for rolling H-beams can be decreased.

In the embodiment of the present invention, when not only the flange width reduction rollers 832, 833, 834, 835 but also the flange thickness reduction rollers 830, 831 are driven by the first rotary drive devices 820*a*, 821*a* and the second rotary drive device 850, the web of the H-beam 13 is given a predetermined pushing force and the flange of the H-beam 13 is also given a predetermined pushing force, so that the H-beam can be pushed out. Due to the foregoing, the reduction force of the web thickness reduction roller can be decreased. Therefore, the occurrence of web waves, which are caused when an H-beam, the web thickness of which is much thinner than the flange thickness, is rolled, can be prevented. Due to the above structure, the following advantages can be provided. When an H-beam is sent out from the rolling mill after the web thickness reduction has been completed and the H-beam has been kicked out from the rolling mill, a sufficiently high intensity of transfer force can be given to the H-beam 13. Therefore, the H-beam can be smoothly rolled.

Referring to several embodiments, the present invention is explained above. However, it should be noted that the present invention is not limited to the above specific embodiments, and variations may be made by one skilled in the art without departing from the spirit and scope of claim of the present invention.

For example, in the second embodiment of the present invention shown in FIGS. 21 and 22, the first 214*a* and the second web thickness reduction roller 214*b* are made to come close to each other in the horizontal direction by the stationary wedge ring 240 and the movable wedge ring 241, and also the first 214*a* and the second web thickness reduction roller 214*b* are separated from each other in the horizontal direction by the stationary wedge ring 240 and the movable wedge ring 241. However, the present invention is not limited to the above specific embodiment. For example, as shown in FIG. 33, the first and the second web thickness reduction roller may be driven by hydraulic cylinders.

Figure 33:
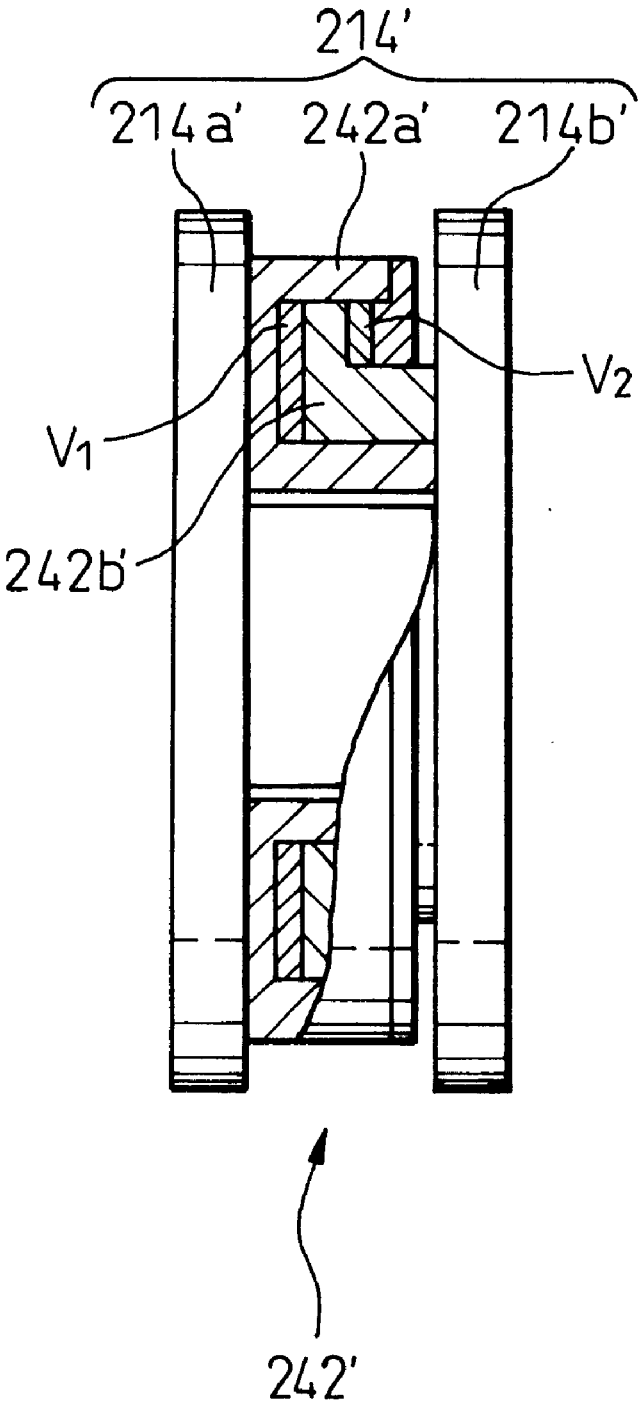
FIG. 33 is a partially broken side view of a variation of the drive unit of the web thickness reduction rolling section shown in FIG. 22.

That is, as shown in FIG. 33, the web thickness reduction roller 214' is provided with the width adjustment rings 242' for driving the first 214*a*' and the second web thickness reduction roller 214*b*'. The width adjustment rings 242' include the cylinders 242*a*' and the pistons 242*b*'. Therefore, when pressurized fluid is supplied to pressure chambers V1 and V2, preferably when pressurized hydraulic fluid is supplied to pressure chambers V1 and V2, the first 214*a*' and the second web thickness reduction roller 214*b*' can be driven in the horizontal direction.

What is claimed is:

1. A multifunction rolling mill for rolling an H-beam comprising: a pair of right and left vertical rollers composed of flange thickness reduction rollers; and a pair of upper and lower horizontal rollers having web thickness reduction rolling sections and flange width reduction rolling sections, the flange width reduction rolling sections being mounted via a retracting mechanism, arranged at both ends of the web thickness reduction rolling sections, for moving the flange width reduction rolling sections in the vertical direction, wherein the flange width reduction rolling sections of the horizontal rollers are moved out of the space between the vertical rollers in the vertical direction when flange thickness reduction and the web thickness reduction are conducted by the vertical rollers and the horizontal rollers so that the flange width reduction rolling sections of the horizontal rollers do not interfere with the vertical rollers.

2. A multifunction rolling mill for rolling an H-beam according to claim 1, wherein both reduction faces of the flange width reduction rolling sections are formed into annular tapered faces, the diameters of which are gradually symmetrically decreased toward the centers of the flange thickness reduction rollers.

3. A rolling method of rolling an H-beam with a multifunction rolling mill including a pair of right and left vertical rollers composed of flange thickness reduction rollers and a pair of upper and lower horizontal rollers having web thickness reduction rolling sections and flange width reduction rolling sections, the flange width reduction rolling sections being mounted via a retracting mechanism, arranged at both ends of the web thickness reduction rolling sections, for moving the flange width reduction rolling sections in the vertical direction, the rolling method of rolling an H-beam with a multifunction rolling mill comprising the steps of:

conducting web thickness rolling of the H-beam with the web thickness reduction rolling sections of the horizontal rollers and also conducting flange width rolling of the H-beam with the flange width reduction rolling sections arranged on both sides of the horizontal rollers under the condition that the right and left vertical rollers are retracted to positions where the right and left vertical rollers do not interfere with the upper and lower flange width reduction rolling sections when edging rolling is conducted on the H-beam, and conducting web thickness rolling on the H-beam with the web thickness reduction rolling section arranged at the horizontal rollers and also conducting flange thickness rolling on the H-beam with the vertical rollers under the condition that the right and the left flange width reduction rolling sections arranged at the horizontal rollers are retracted to positions where the right and the left flange width reduction rolling sections do not interfere with the right and the left vertical rollers when universal rolling is conducted on the H-beam.

4. A rolling method of rolling an H-beam with a multifunction rolling mill for rolling an H-beam, the rolling mill comprising a pair of right and left vertical rollers composed of flange thickness reduction rollers; and a pair of upper and lower horizontal rollers having web thickness reduction rolling sections and flange width reduction rolling sections, the flange width reduction rolling sections being mounted via a retracting mechanism, arranged at both ends of the web thickness reduction rolling sections, for moving the flange width reduction rolling sections in the vertical direction, wherein the flange width reduction rolling sections of the horizontal rollers are moved out of the space between the vertical rollers in the vertical direction when flange thickness reduction and the web thickness reduction are conducted by the vertical rollers and the horizontal rollers so that the flange width reduction rolling sections of the horizontal rollers do not interfere with the vertical rollers, the method comprising the steps of:

conducting universal rough rolling, edging rolling and universal finish rolling while a piece of work to be rolled is being reciprocated between the universal rough rolling mill and the multifunction rolling mill, wherein the universal rough rolling can be also conducted by the multifunction rolling mill.

* * * * *